US009119428B2

(12) United States Patent
Kuelker

(10) Patent No.: US 9,119,428 B2
(45) Date of Patent: Sep. 1, 2015

(54) GARMENT

(71) Applicant: 1750481 ALBERTA INC., Calgary (CA)

(72) Inventor: Shane Renard Kuelker, Calgary (CA)

(73) Assignee: 1750481 ALBERTA INC., Calgary, Alberta (CA)

( * ) Notice: Subject to any disclaimer, the term of this patent is extended or adjusted under 35 U.S.C. 154(b) by 0 days.

(21) Appl. No.: 14/270,251

(22) Filed: May 5, 2014

(65) Prior Publication Data

US 2014/0325734 A1 Nov. 6, 2014

Related U.S. Application Data

(60) Provisional application No. 61/820,008, filed on May 6, 2013.

(51) Int. Cl.

*A41D 3/02* (2006.01)
*A41D 13/02* (2006.01)
*A41F 1/00* (2006.01)

(52) U.S. Cl.

CPC ..... *A41D 13/02* (2013.01); *A41D 2400/44* (2013.01); *A41F 1/00* (2013.01)

(58) Field of Classification Search

CPC ..... A41D 1/06; A41D 13/02; A41D 1/08; A41D 11/00; A41D 9/08; A41D 13/1263; A41D 3/005; B63C 11/04; A62B 17/001; B64D 10/00; B64D 2010/005; A41F 1/00

USPC ..... 2/2.17, 79, 227, 69, 2.14, 2.11, 70, 72, 2/78.1, 78.3, 78.4, 80, 82, 83, 111, 96, 2/105, 69.5

See application file for complete search history.

(56) References Cited

U.S. PATENT DOCUMENTS

| | | | | |
|---|---|---|---|---|
| 2,008,152 | A | 7/1935 | Nier | |
| 2,264,958 | A | 12/1941 | Smith | |
| 2,588,542 | A | 3/1952 | Kunz | |
| 3,493,972 | A * | 2/1970 | Walter | 2/2.17 |
| 3,555,567 | A | 1/1971 | Owen | |
| 3,738,367 | A | 6/1973 | Hardy | |
| 4,117,609 | A | 10/1978 | Helt | |

(Continued)

FOREIGN PATENT DOCUMENTS

| | | |
|---|---|---|
| CA | 2285699 A1 | 4/2001 |
| JP | 06-049701 | 2/1994 |

OTHER PUBLICATIONS

"Double Zipper Boilersuit Parachute One-Piece Vintage Gray Coveralls", www.etsy.com/listing/67050817/double-zipper-boilersuit-parachute-one.

(Continued)

*Primary Examiner* — Tejash Patel
(74) *Attorney, Agent, or Firm* — Stephen M. De Klerk

(57) ABSTRACT

A garment including a trunk portion and a pair of leg portions extending from the trunk portion. An opening extends along the trunk portion between a distal trunk opening and along the leg portions to distal ends of the leg portions for facilitating donning and doffing the garment by receiving a user within the trunk opening and leg openings. The opening extends along the leg portions on a pair of paths which avoid a kneecap portion, an inside leg portion, and an area between the kneecap portion and the inside leg portion, of each leg portion.

33 Claims, 25 Drawing Sheets

(56) References Cited

U.S. PATENT DOCUMENTS

| | | | | |
|---|---|---|---|---|
| 5,537,686 | A | 7/1996 | Krutz, Jr. et al. | |
| D438,364 | S | 3/2001 | Knoefel | |
| 6,219,841 | B1 * | 4/2001 | Anderson | 2/2.17 |
| 6,305,027 | B2 | 10/2001 | Chou | |
| 6,477,712 | B1 * | 11/2002 | Jones | 2/69 |
| 6,477,716 | B2 | 11/2002 | Blaire | |
| 6,675,389 | B1 | 1/2004 | Kublick | |
| 7,966,672 | B1 | 6/2011 | Hagerman et al. | |
| D676,628 | S | 2/2013 | Rogers | |
| 2007/0277278 | A1 | 12/2007 | O'brien | |
| 2011/0113523 | A1 | 5/2011 | Lobas | |
| 2011/0219512 | A1 | 9/2011 | Davis | |
| 2011/0307993 | A1 | 12/2011 | McAfee | |
| 2012/0317700 | A1 | 12/2012 | Vanderburgh | |

OTHER PUBLICATIONS

International Search Report and Written Opinion, International PCT Application No. PCT/CA2014/050426, International Filing Date May 5, 2014, Jul. 17, 2014, (11 pages).

* cited by examiner

GARMENT

CROSS REFERENCE TO RELATED APPLICATIONS

This application claims the benefit of priority of U.S. Provisional Patent Application No. 61/820,008 filed May 6, 2013, which is hereby incorporated by reference.

FIELD

The present disclosure relates generally to garments for the trunk and legs of a user.

BACKGROUND

It is time consuming to don and doff conventional coveralls. In some examples it may be impossible to don or doff coveralls while wearing work boots. In other cases, it may be possible but difficult and may result in the inside of the coveralls being soiled. As a result of this difficulty, workers frequently leave their coveralls on, or doff only an upper part of their coveralls, while using indoor facilities at job sites (e.g. cafeterias, washrooms, etc.). Keeping coveralls on while using indoor facilities may compromise cleanliness and hygiene of the workers or of the facilities.

A partially doffed coverall (with an upper portion of the coverall inverted) is the compromise workers often make to avoid the hassle of soiled socks and extra time required to doff and don work boots to remove coveralls completely. Valuable items also tend to fall out of breast pockets while coveralls are partially donned or doffed, such as notepads, pens or gas detection equipment. Partially doffed conventional coveralls are frequently encountered on construction sites in the following circumstances: to use the washroom, to cool down, during coffee break, during lunch breaks. If a user's partially doffed coveralls come into contact with the washroom floor while using the toilet, the coveralls will likely become soiled and it is rare that the user has a fresh clean set of coveralls to change into. The user then is forced to work the remainder of the day, and possibly eat, in the same coveralls. In particular, a sleeve portion of partially doffed coveralls is likely to contact with the floor in a washroom during use. For these reasons, in addition to regular chemical or other sources of contamination that are frequently encountered in the workplace, it is ideal to remove coveralls completely prior to entering the washroom, vehicles, or dining facilities. However, this is time consuming and users frequently do not remove coveralls completely.

U.S. Pat. No. 7,966,672 to Hagerman et al. (Jun. 28, 2011), entitled "Clothing with Special Access", depicts a garment with a special access mechanism to enable an inseam to be opened. When the inseam is opened, a bottom portion of the legs can be fastened to an upper portion of the legs in a raised position. An inseam zipper extends continuously from the bottom edge of the left leg portion, up along the crotch and down to the bottom edge of the right leg portion along the inseam. Each leg also includes an outer zipper parallel to and opposite to the inseam zipper, extending along the outer seam from the bottom edge of the leg to calf-height or just below knee-height to aid in donning/removing footgear. The inseam zipper is an open-ended zipper which uses a "box and pin" mechanism to lock the two sides of the zipper into place, the same type as is often used in jackets, so its two sides can be completely separated when the zipper is opened.

U.S. Pat. No. 6,675,389 to Kublick (Jan. 13, 2004), entitled "Garment with Zippers Enabling Easy Access", depicts a wetsuit with separate jacket and pants. The leg-sleeves have zippers running lengthwise, whereby the sleeves can be completely opened up. The leg-sleeves of the pants have seams which extend down the front of the leg sleeves.

U.S. Pat. No. 2,008,152 to Henry V. Nier (Jul. 16, 1935), entitled "Garment", depicts a garment which when in use completely covers the wearer. The garment has openings arranged to permit the garment being readily put on or taken off, with the openings adapted to be readily closed so that the garment completely encloses the wearer. The garment has a longitudinal opening medially of a portion of the garment which is adapted to cover the trunk of the body. The garment includes a hood. Additional openings extend along portions of the garment which are adapted to receive projecting parts of the body such as the legs, so that by unfastening both the longitudinal medial opening and said additional openings, the entire garment may be readily put on or taken off.

The openings of Nier extend down the front of the trunk portion of the garment to the crotch. At the crotch the opening branches to form continuations of the opening extending down the respective legs. Running fasteners are provided for the openings, with a first slide to be drawn downwardly to the crotch from top of the hood for closing the continuous opening, and second and third slides adapted to be drawn upwardly to the crotch 6 and along each of the openings along the legs for respectively closing these openings. The garment may be readily put on by unfastening the various openings, with the garment completely enclosing the body when the openings have been closed as shown in FIG. 1 of Nier, and a portion of the body adapted to be readily exposed while the rest of the body remains covered, by partially opening any one of the fasteners.

U.S. Pat. No. D438,364 entitled "Infant Overalls" to Knoefel of Mar. 6, 2001 depicts a pair of infant overalls. As this is a design patent, there is no text. The figures depict a pair of overalls for an infant with what appear to be openings extending along each leg over the knees. Above the crotch the two leg openings meet each other and a third opening which extends to the neck of the overalls.

U.S. Pat. No. D676,628 entitled "Coverall" to Rogers of Feb. 26, 2013 depicts a pair of coveralls. As this is a design patent, there is no text. The figures depict a pair of coveralls with an opening extending between the neck of the coveralls and the end of each leg. The opening extends along the legs proximate the inside leg. In between the two openings is a third opening extending between the neck and the crotch.

SUMMARY

It is an object of the present disclosure to obviate or mitigate at least one disadvantage of previous garments having a trunk portion and leg portions (e.g. coveralls, winter sport suits, etc.). An easy access garment is provided herein. The garment has a continuous opening extending from the trunk portion to a distal end of each leg. The opening allows the garment to be donned by receiving the user's trunk, arms, and legs within the opening (e.g. similarly to donning a trench coat or other long coat, etc.) and then the opening is fastened closed. Similarly, the garment can be doffed by unfastening the opening and removing the garment (e.g. similarly to doffing a trench coat or other long coat, etc.). These features allow the garment to be donned and doffed while wearing bulky footwear (e.g. work boots, winter sport boots, etc.). These features also allow the garment to be donned and doffed while keeping the garment substantially upright, without having to pull the garment over the user's head, and without inverting the trunk portion (inverting the trunk portion may result in items falling out of pockets). Along each leg portion, the opening follows a path which does not cross a kneecap portion of the leg portion (corresponding to where a user's kneecap would be) and which does not cross an inside leg portion of the leg portion (corresponding to the user's inside leg). These features make the garment more suitable for use where kneeling is required or in other physical activity (e.g. heavy labour on an industrial or construction site, winter sports, etc.).

In a first aspect, the present disclosure provides a garment including a trunk portion and a pair of leg portions extending from the trunk portion. An opening extends along the trunk portion between a distal trunk opening and along the leg portions to distal ends of the leg portions for facilitating donning and doffing the garment by receiving a user within the trunk opening and leg openings. The opening extends along the leg portions on a pair of paths which avoid a kneecap portion, an inside leg portion, and an area between the kneecap portion and the inside leg portion, of each leg portion.

In a further aspect, the present disclosure provides a garment comprising a trunk portion; a pair of leg portions extending from the trunk portion; a trunk opening extending along the trunk portion between a distal trunk opening end and an opening point on the trunk portion; a pair of leg openings extending between distal ends of the leg portions and the opening point, the leg openings extending along the leg portions on a pair of paths which avoid a kneecap portion, an inside leg portion, and an area between the kneecap portion and the inside leg portion, of each leg portion; and fasteners for reversibly closing the trunk opening and the leg openings. The trunk opening intersects with the leg openings proximate the opening point for facilitating donning and doffing the garment by receiving a user within the trunk opening and leg openings.

In an embodiment, the paths extend along the leg portions within a pair of path cross-sectional areas of the leg portions, each path cross-sectional area being between a first midpoint and a second midpoint, the first midpoint located between a frontal centerline portion of the leg portion and an outside leg portion of the leg portion, and the second midpoint located between a rear centerline portion of the leg portion and the inside leg portion. In an embodiment, the path cross-sectional areas are each between the first midpoint and a third midpoint, the third midpoint located between the rear centerline of the leg portion and the outside leg portion. In an embodiment, the path cross-sectional areas are within about 30 degrees of the outside leg portions. In an embodiment, the path cross-sectional areas are within about 15 degrees of the outside leg portions. In an embodiment, the paths extend substantially along the outside leg portions.

In an embodiment, the paths extend in substantially straight lines along the leg portions.

In an embodiment, the garment includes a connector extending from a first point on the garment for connecting to a second point on the garment, the second point being across the trunk opening from the first point.

In an embodiment, the garment includes a connector extending from a first point on the garment for connecting to a second point on the garment, the second point being across a first leg opening of the pair of leg openings from the first point. In an embodiment, the connector is also for connecting to a third point on the garment, the third point being across a second leg opening of the pair of leg openings from the first point.

In an embodiment, the garment includes a connector extending from a first point on the garment for connecting to a second point on the garment, the second point being across the opening point from the first point.

In an embodiment, the garment includes a trunk connector extending from the garment along a first side of the trunk opening for connecting to the garment on a second side of the trunk opening. In an embodiment, the trunk connector extends from the garment along the first side of the trunk opening for connecting to the garment across the opening point from the first side of the trunk opening.

In an embodiment, the garment includes a trunk connector extending from the garment along a first side of the trunk opening for connecting to the garment on a second side of the trunk opening. In an embodiment, the garment includes a first leg connector extending from the garment along a first side of a first leg opening of the pair of leg openings for connecting to the garment on a second side of the first leg opening; and a second leg connector extending from the garment along a first side of a second leg opening of the pair of leg openings for connecting to the garment on a second side on the second leg opening. In an embodiment, the first leg connector extends along the first side of the first leg opening from the opening point to a first point; and the second leg connector extends along the first side of the second leg opening from the opening point to a second point; the garment further includes a third leg connector extending along the second side of the first leg opening from the first point to a third point for connecting to the garment on the first side of the first leg opening; and a fourth leg connector extending along the second side of the second leg opening from the second point to a fourth point for connecting to the garment on the first side of the first leg opening; and the first side of each leg opening faces a rear of the garment and the second side of each leg opening faces a front of the garment. In an embodiment, the first point and the second point are each proximate a hip portion of the garment.

In an embodiment, the garment includes a trunk connector extending from the garment along a first side of the trunk opening for connecting to the garment on a second side of the trunk opening. In an embodiment, the garment includes a first leg connector extending from the garment along a first side of a first leg opening of the pair of leg openings for connecting to the garment on a second side of the first leg opening; and a second leg connector extending from the garment along a first side of a second leg opening of the pair of leg openings for connecting to the garment on a second side on the second leg opening. In an embodiment, the first leg connector extends along the first side of the first leg opening from the opening point to a first point; and the second leg connector extends along the first side of the second leg opening from the opening point to a second point; the garment further includes a third leg connector extending along the second side of the first leg opening from the first point to a third point for connecting to the garment on the first side of the first leg opening; and a fourth leg connector extending along the second side of the second leg opening from the second point to a fourth point for connecting to the garment on the first side of the first leg opening; and the first side of each leg opening faces a rear of the garment and the second side of each leg opening faces a front of the garment. In an embodiment, the third point and the fourth point are each proximate an end of each leg portion of the pair of leg portions.

In an embodiment, the garment includes a trunk connector extending from the garment along a first side of the trunk opening for connecting to the garment on a second side of the trunk opening. In an embodiment, the garment includes a first leg connector extending from the garment along a first side of a first leg opening of the pair of leg openings for connecting to the garment on a second side of the first leg opening; and a second leg connector extending from the garment along a first side of a second leg opening of the pair of leg openings for connecting to the garment on a second side on the second leg opening. In an embodiment, the first leg connector extends along the first side of the first leg opening from the opening point to a first point; and the second leg connector extends along the first side of the second leg opening from the opening point to a second point; the garment further includes a third leg connector extending along the second side of the first leg opening from the first point to a third point for connecting to the garment on the first side of the first leg opening; and a fourth leg connector extending along the second side of the second leg opening from the second point to a fourth point for connecting to the garment on the first side of the first leg opening; and the first side of each leg opening faces a rear of the garment and the second side of each leg opening faces a front of the garment. In an embodiment, the fastener comprises a trunk zipper for closing the trunk opening, a first leg zipper for closing the first leg opening, and a second leg zipper for closing the second leg opening; and the trunk connector comprises a lip for covering the trunk zipper, the first leg connector and third leg connector each comprise a lip for covering the first leg zipper, and the second leg connector and fourth leg connector each comprise a lip for covering the second leg zipper.

In an embodiment, the opening point is located above a hip portion of the garment.

In an embodiment, the distal trunk opening end is located at a neck opening of the trunk portion.

In an embodiment, the garment includes leg flaps proximate the distal ends of the leg portions for wrapping around a user's legs to secure the leg portions around the user's legs.

In a further aspect, the present disclosure provides a garment comprising a trunk portion; a pair of leg portions extending from the trunk portion; a pair of openings extending along the trunk portion and the leg portions between a distal trunk opening end and distal ends of the leg portions to facilitate donning and doffing the garment by receiving a user within the openings, the openings extending along the leg portions on a pair of paths which avoid a kneecap portion, an inside leg portion, and an area between the kneecap portion and the inside leg portion, of each leg portion; and fasteners for reversibly closing the openings.

In an embodiment, the paths extend along the leg portions within a pair of path cross-sectional areas of the leg portions, each path cross-sectional area being between a first midpoint and a second midpoint, the first midpoint located between a frontal centerline portion of the leg portion and an outside leg portion of the leg portion, and the second midpoint located between a rear centerline portion of the leg portion and the inside leg portion. In an embodiment, the path cross-sectional areas are each between the first midpoint and a third midpoint, the third midpoint located between the rear centerline of the leg portion and the outside leg portion. In an embodiment, the path cross-sectional areas are within about 30 degrees of the outside leg portions. In an embodiment, the path cross-sectional areas are within about 15 degrees of the outside leg portions. In an embodiment, the paths extend substantially along the outside leg portions. In an embodiment, the paths extend in substantially straight lines along the leg portions.

In an embodiment, the garment includes a connector extending from a first point on the garment for connecting to a second point on the garment, the second point being across a first opening of the pair of openings from the first point. In an embodiment, the connector is also for connecting to a third point on the garment, the third point being across a second opening of the pair of openings from the first point.

In an embodiment, the garment includes a connector extending from a first point on the garment for connecting to a second point on the garment, the second point being across a first opening of the pair of openings from the first point. In an embodiment, the first point is on an intermediate flap defined between the pair of openings and the garment includes a connection point on the garment for connecting to the connector to prevent the intermediate flap from contacting a surface upon which the user is standing when the pair of openings are open.

In an embodiment, the distal trunk opening end is located at a neck opening of the trunk portion.

In an embodiment, the garment includes leg flaps proximate the distal ends of the leg portions for wrapping around the user's legs to secure the leg portions around the user's legs.

In a further aspect, the present disclosure provides a garment comprising a trunk portion; a pair of leg portions extending from the trunk portion; a trunk opening extending along the trunk portion between a distal trunk opening end and an opening point on the trunk portion; a pair of leg openings extending between distal ends of the leg portions and the opening point, the leg openings extending along the leg portions on a pair of paths which extend along the leg portions within a cross-sectional area of the leg portions within about 15 degrees of outside leg portions of the leg portions; fasteners for reversibly closing the trunk opening and the leg openings; and a connector extending from a first point on the garment for connecting to a second point on the garment, the second point being across a first leg opening of the pair of leg openings from the first point. The trunk opening intersects with the leg openings proximate the opening point for facilitating donning and doffing the garment by receiving a user within the trunk opening and leg openings.

In an embodiment, the paths extend substantially along the outside leg portions.

In an embodiment, the connector is further for connecting to a third point on the garment, the third point being across a second leg opening of the pair of leg openings from the first point.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures. In the attached figures, corresponding elements in different examples have corresponding reference numerals.

DETAILED DESCRIPTION

Figure 1:
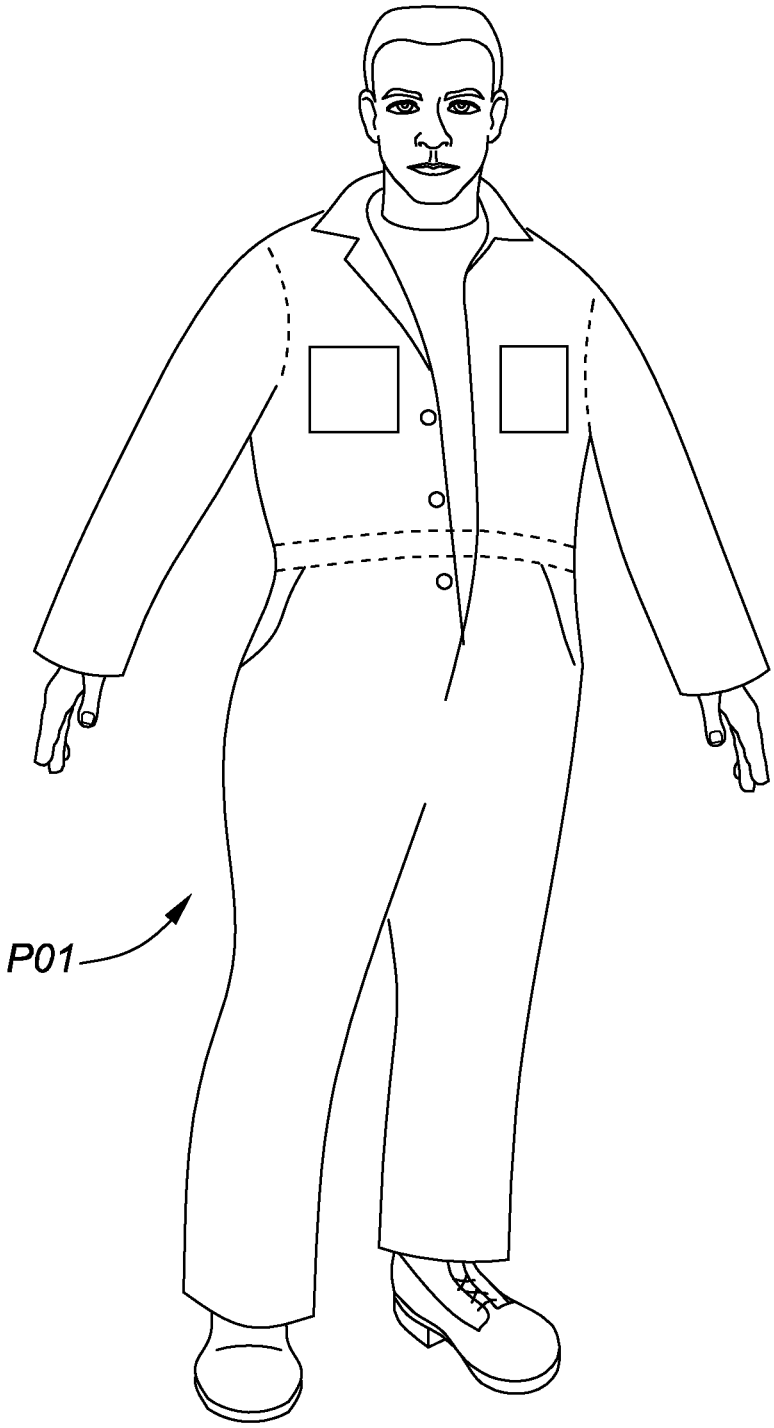
PRIOR ART FIG. 1
FIG. 1 is a frontal view of a prior art conventional coverall.
Figure 2:
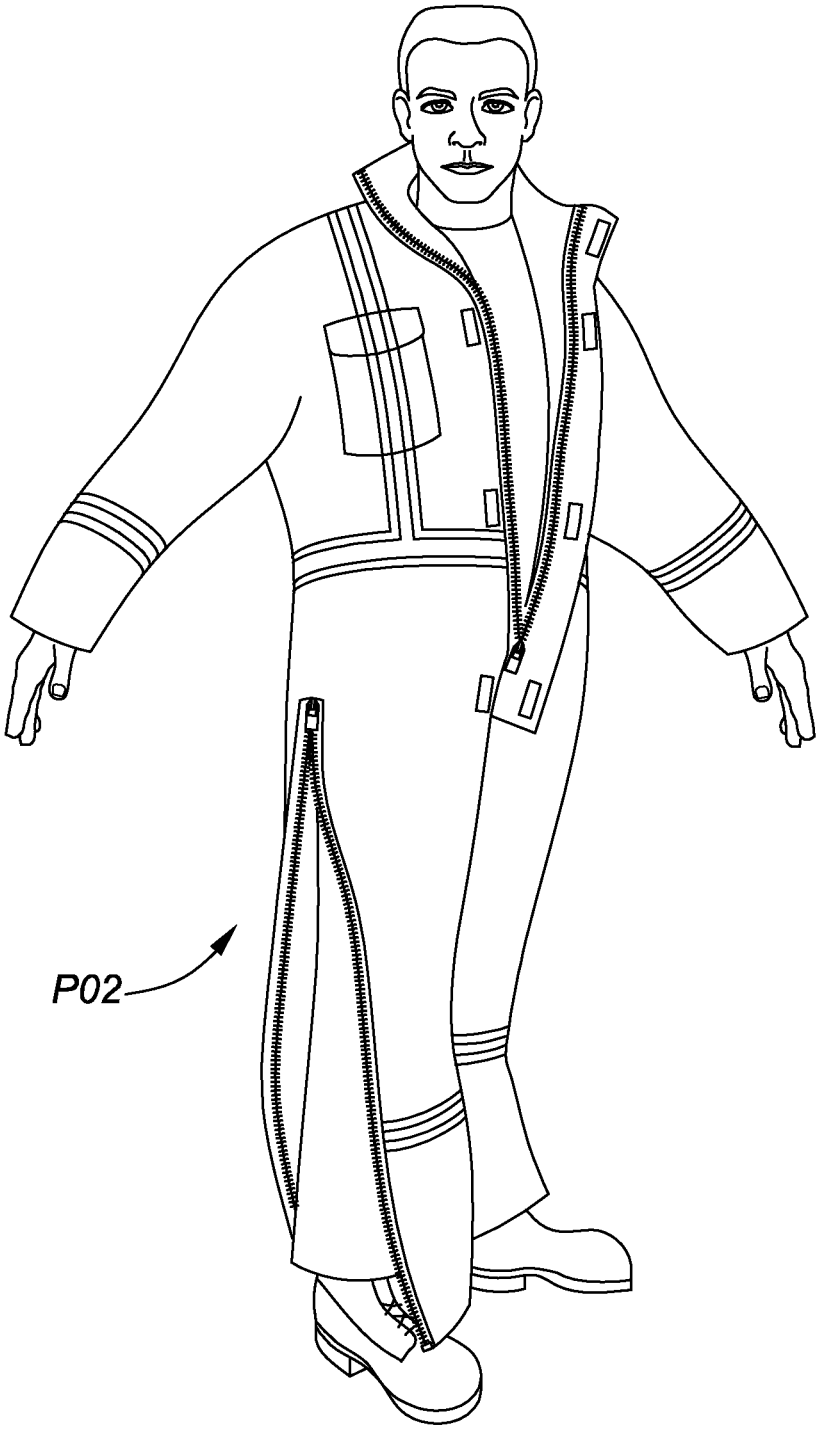
PRIOR ART FIG. 2
FIG. 2 is a frontal view of an alternative prior art conventional coverall.

FIGS. 1 and 2 respectively show examples of conventional coveralls P01 and P02. When donning and doffing the conventional coveralls P01 or P02, the user must step into the coverall by inserting each of the user's feet and legs through the legs of the coveralls when donning and step out of the coverall by withdrawing each of the user's feet and legs from each leg of the coveralls when doffing. When doffing the coveralls, this may result, for example, in the user removing their right boot and balancing on their left foot while removing their right leg from the coveralls. This is difficult and often results in the coveralls contacting the ground, or one of the user's feet stepping on the typically dirty floor or ground with no boot. Donning and doffing conventional coveralls from a standing position and without stepping on the ground with a foot lacking footwear is difficult, and is often simplified by providing a chair or other seating.

Donning and doffing conventional coveralls while wearing footwear may be possible in some instances where the user has small feet or footwear that is not bulky. However, in many instances, coveralls are used in combination with bulky footwear. In addition, it is common for footwear to become dirty while working wearing coveralls, and if a foot including footwear is forced through a leg opening of a pair of coveralls, the inside of the coveralls is likely to be soiled, likely soiling the user's clothing underneath. The above complications with conventional coveralls may equally apply in other contexts where garments having a trunk portion and leg portions extending therefrom are used (e.g. full-body suits for winter sports, costumes, etc.).

Garments with openings extending along an inside leg or across the frontal centerline of the legs may be unsuitable for use during kneeling or other physical activity. The references described above includes such garments. It is, therefore, desirable to provide a garment suitable for wearing while doing physical activity (e.g. working on a job site, winter sports, where kneeling is required, etc.) and which may be donned and doffed while wearing bulky footwear (e.g. work boots, downhill skiing or snowboarding boots, etc.). The garment provides the advantages of being easily donned and doffed while wearing bulky footwear and being suitable for wear during kneeling or other physical activity.

Generally, the present disclosure provides a garment having leg portions and a trunk portion (e.g. a pair of coveralls, a full-body suit for winter sports, etc.) which can be donned and doffed easily while wearing bulky footwear. The garment can be donned and doffed easily through an opening extending between the trunk (e.g. at the neck, shoulder, etc.) and the legs (e.g. at the ankles, calves, etc.). The garment may be donned by receiving the user's trunk, arms, and legs into the opening (e.g. similarly to a trench coat or other long coat, etc.) and then fastening the opening with fasteners (e.g. with zippers, buttons, snaps, hook-and-loop fasteners, laces, etc.). Similarly, the garment may be doffed by unfastening the opening and then removing the garment.

In the garment, the opening is positioned along the legs to avoid being located on the inside leg or the kneecap (e.g. the opening may extend along the outside leg, along a position intermediate the outside leg and the frontal centerline of the legs, etc.). This position of the opening facilitates working or engaging in other physical activity, such as kneeling, when wearing the garment, while mitigating stress on the opening or inconveniencing the user. Placement of the opening along the inside leg would result in the opening being susceptible to being stressed while the user is moving. Placement of the opening along the frontal centerline of the legs also would result in the opening being susceptible to being stressed while the user is moving. In addition, placement of the opening along the frontal centerline at the knee would result in the opening being over the user's kneecap, which may be uncomfortable (e.g. while kneeling, etc.), may interfere with knee pads or other knee protection, may cause a closed opening to open (e.g. where zippers or snap fasteners are present on or near the knee, etc.), or may result in injury to the user.

In addition to convenience, the garment may provide advantages in terms of safety and cleanliness. Advantages in safety may result from facilitating emergency egress from the garment when the user is exposed to a flammable, hot, molten, volatile, or corrosive substance, (e.g. gasoline, industrial acids, caustic chemicals, etc.). In addition, rapid doffing would also allow emergency medical responders to gain access to look for injuries if the user is in an accident (e.g. at a mine site, a construction site, on a ski hill, etc.) or otherwise. Advantages in cleanliness may result from allowing the user to remove the garment without removing footwear prior to using dining or washroom facilities in an environment where conventional coveralls would typically be worn or left partially on for the sake of convenience or to avoid embarrassment when doffing footwear and coveralls due to odour (e.g. at a mine site, a construction site, industrial site, etc.). In addition, equipment in pockets (e.g. cellular telephones, gas detectors, tablets, etc.) is less likely to fall out while doffing the garment as compared to the conventional coveralls P01 or P02, which are typically doffed by first removing and inversing a trunk portion of the coveralls.

Figure 13:
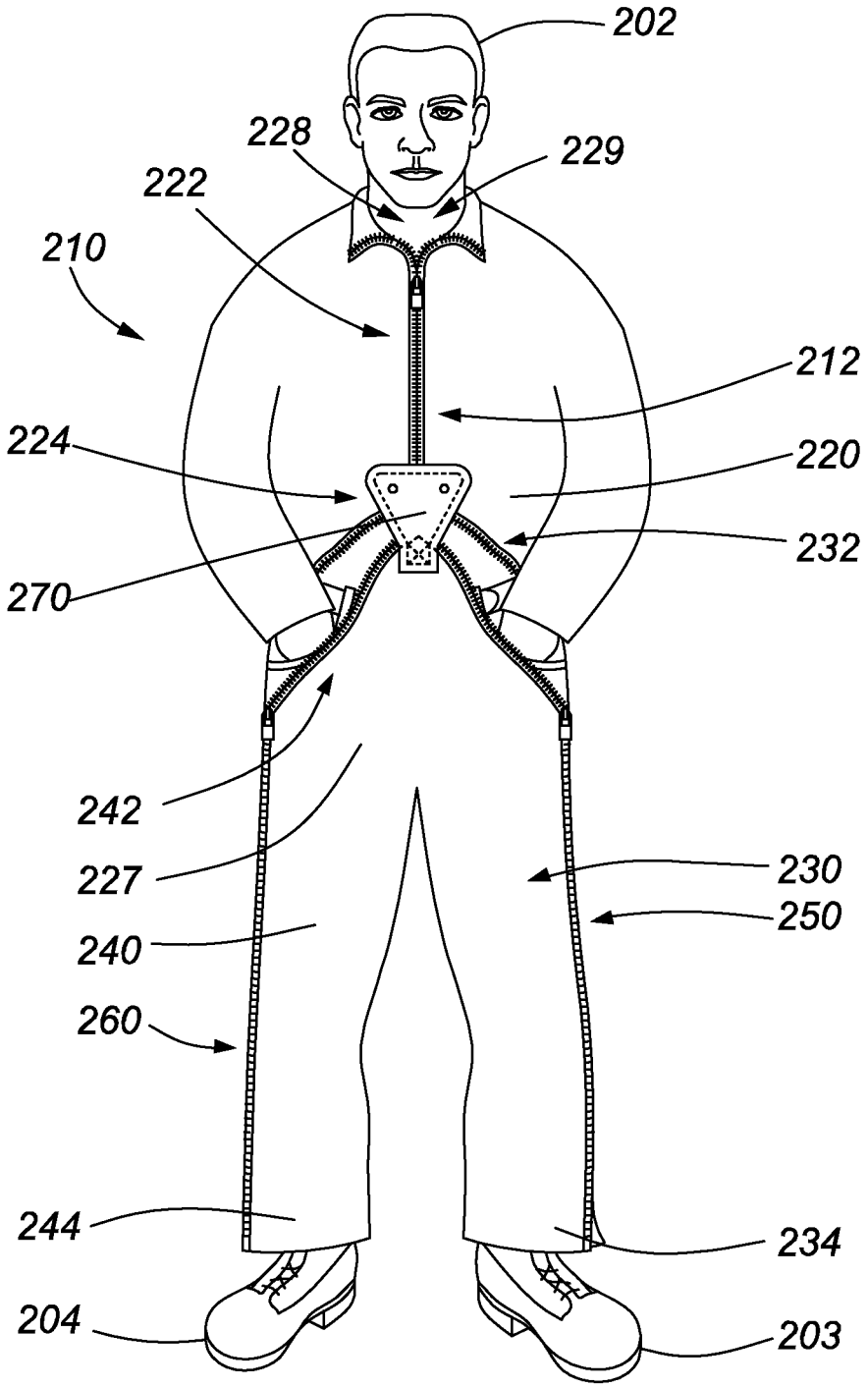
FIG. 13 is a frontal view of the garment of FIG. 12 with partially open leg openings.

The garment also allows easy access to items stored in clothes worn beneath the garment (e.g. in shirt pockets, pant pockets, etc.) without the need for a separate opening. Many examples of conventional coveralls P01 include separate openings for access to pants pockets, which tend to allow dirt and debris to enter the conventional coveralls P01 and contaminate the users clothing. Further, partially opening the leg openings (e.g. as depicted in FIG. 13) could provide the user a means to ventilate the garment during periods of extreme heat or physical activity without removing the garment. The garment also facilitates male urination while donned by allowing easy access to pants and belt worn underneath (e.g. as depicted in FIG. 6), and may also reduce the risk of injury by a zipper when fastening the garment upon concluding urination, relative to the risk when using conventional coveralls P02.

Garment

Figure 3:
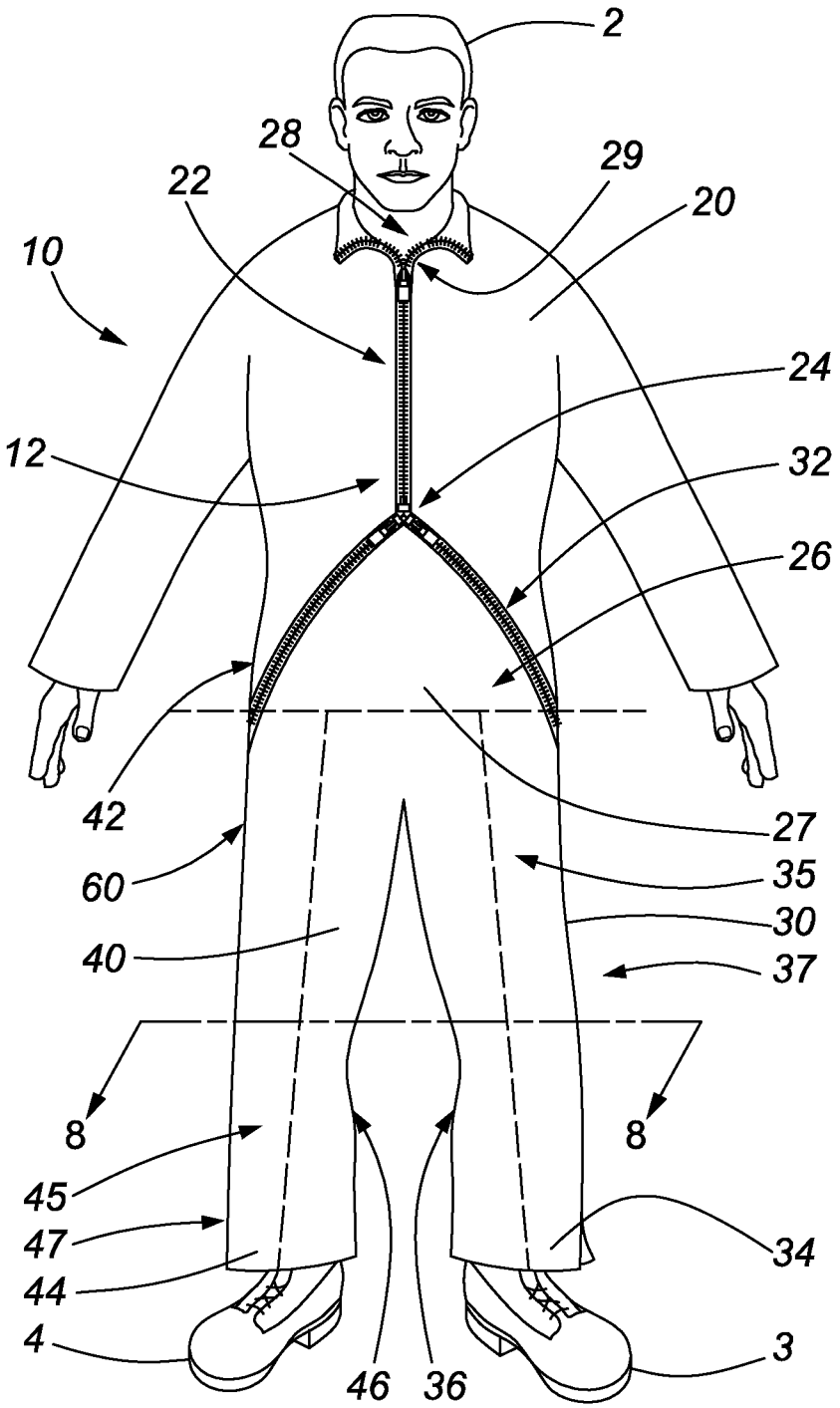
FIG. 3 is a frontal view of a garment in accordance with an embodiment of the present disclosure with a closed opening.
Figure 4:
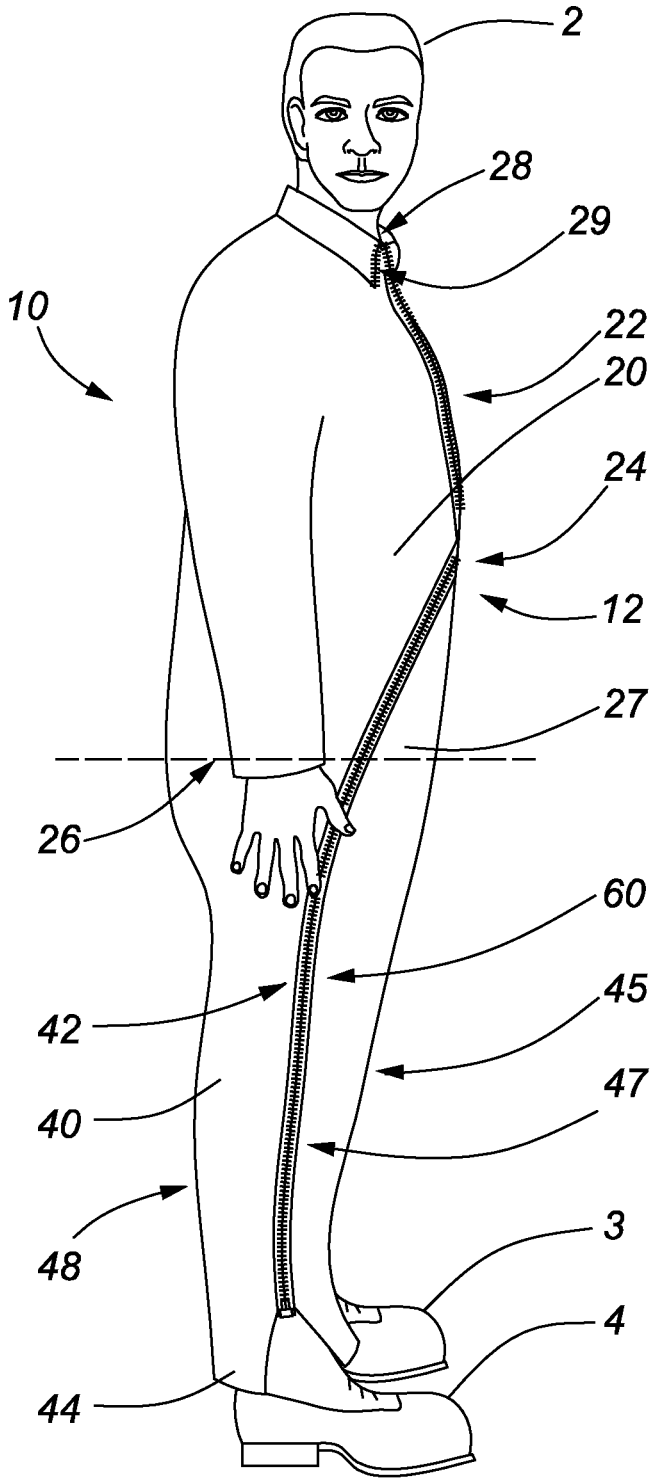
FIG. 4 is a side view of the garment of FIG. 3 with a closed opening.
Figure 5:
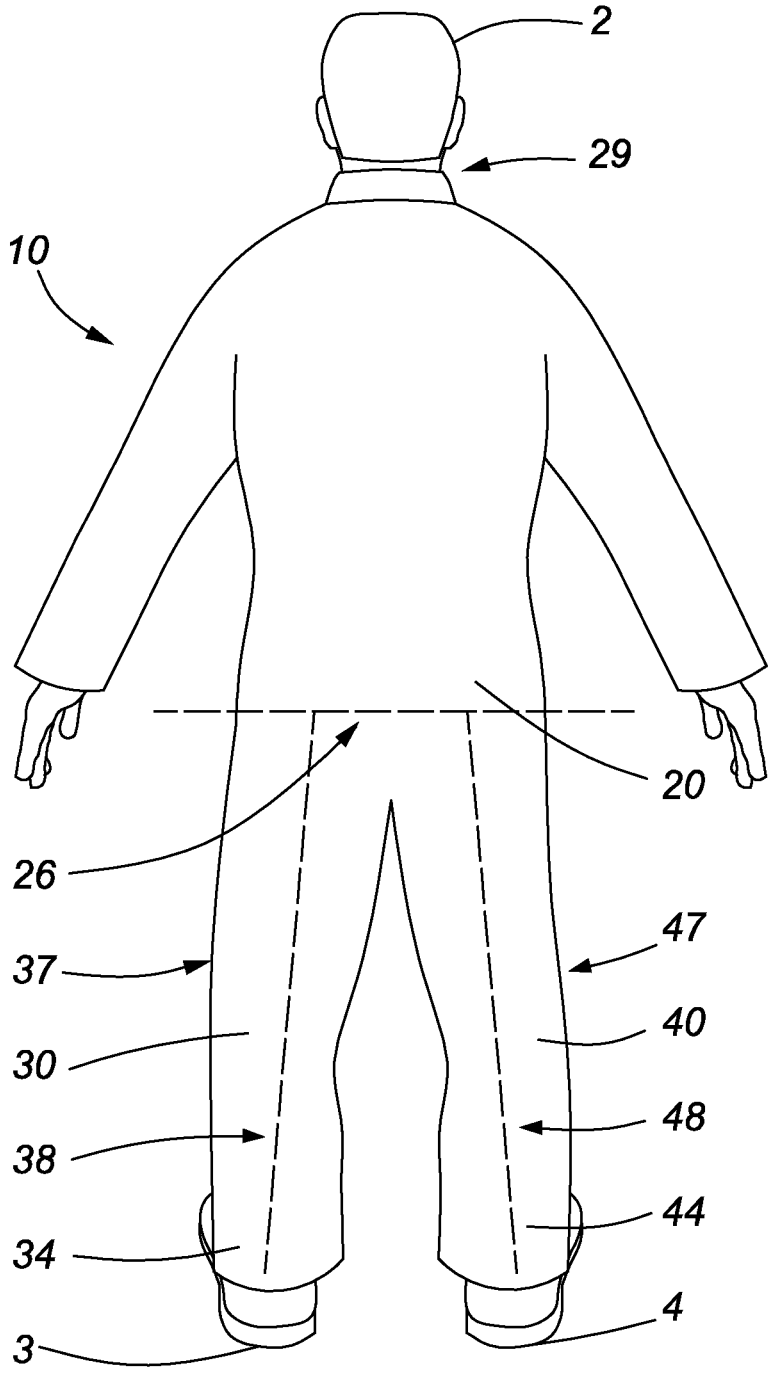
FIG. 5 is a rear view of the garment of FIG. 3 with a closed opening.
Figure 21:
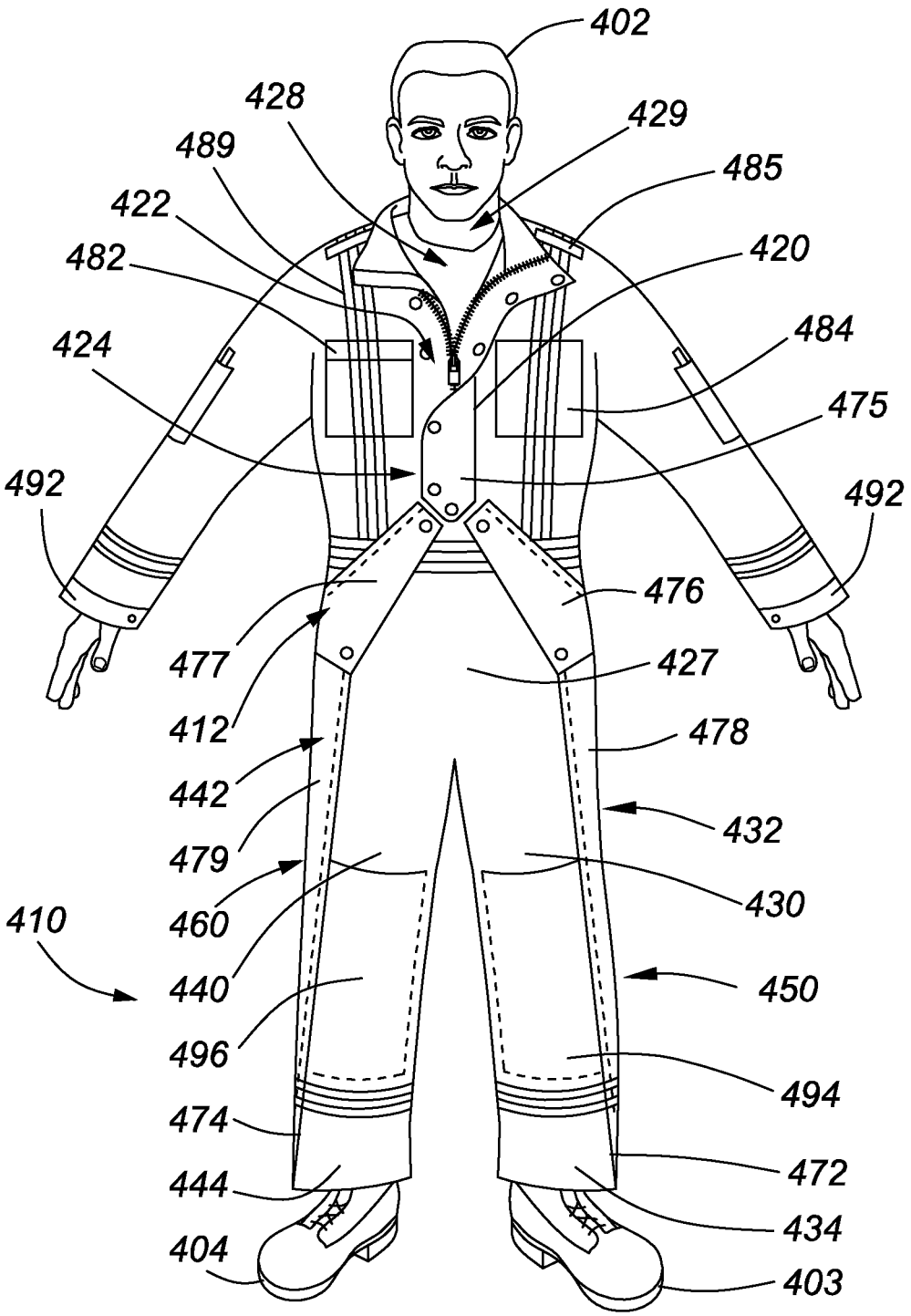
FIG. 21 is a frontal view of a garment in accordance with a further embodiment of the present disclosure with a closed opening.
Figure 22:
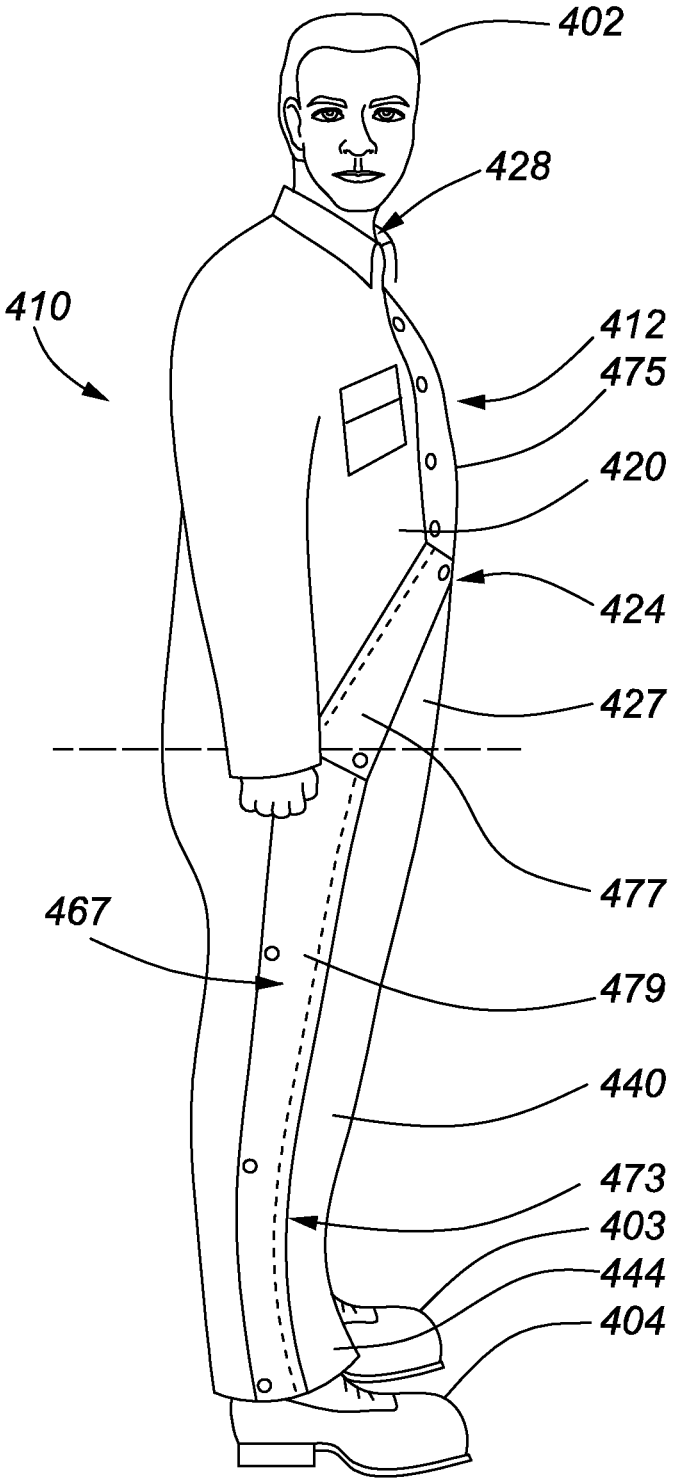
FIG. 22 is a side view of the garment of FIG. 21.
Figure 23:
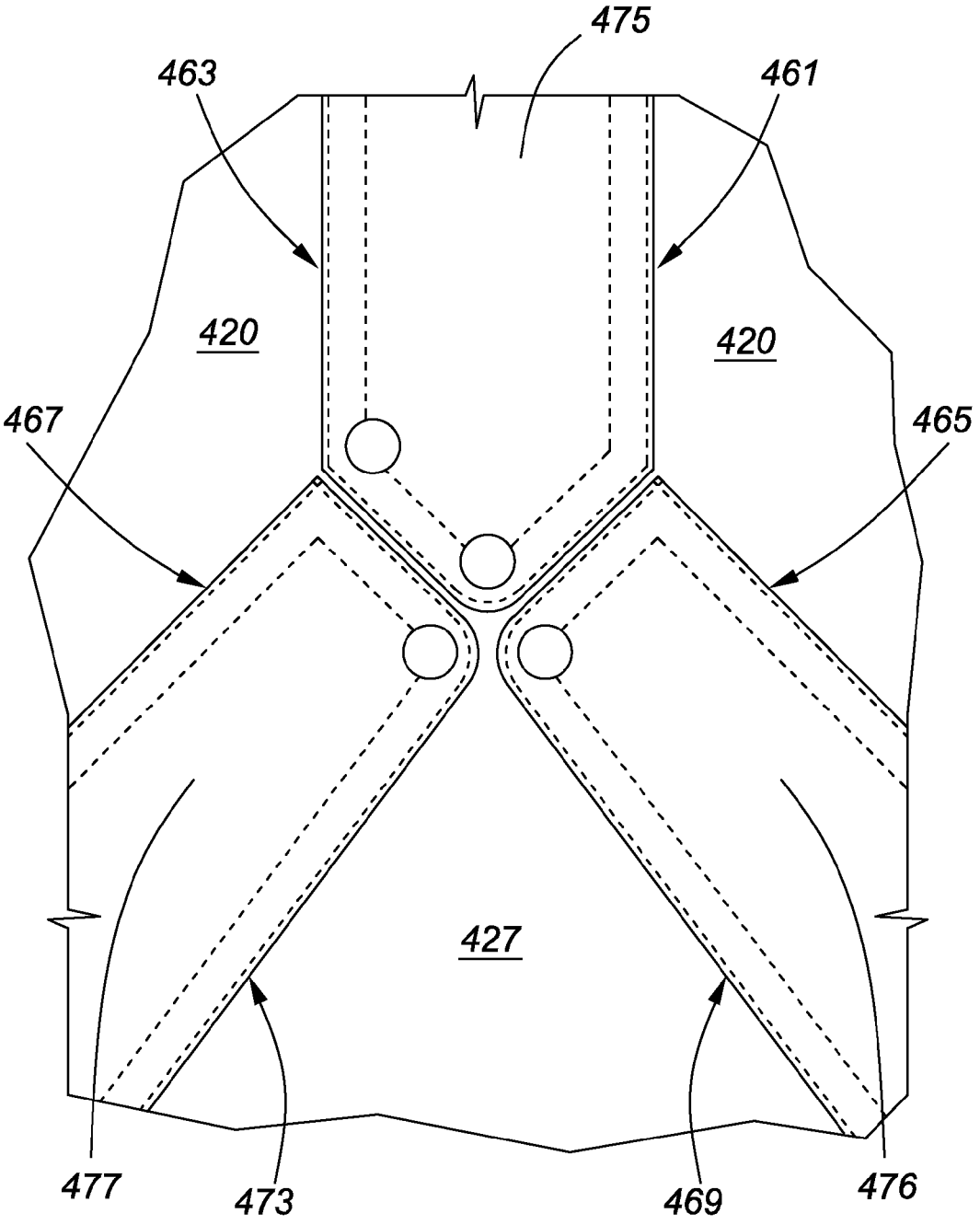
FIG. 23 is a frontal detail view of the garment of FIG. 21.
Figure 24:
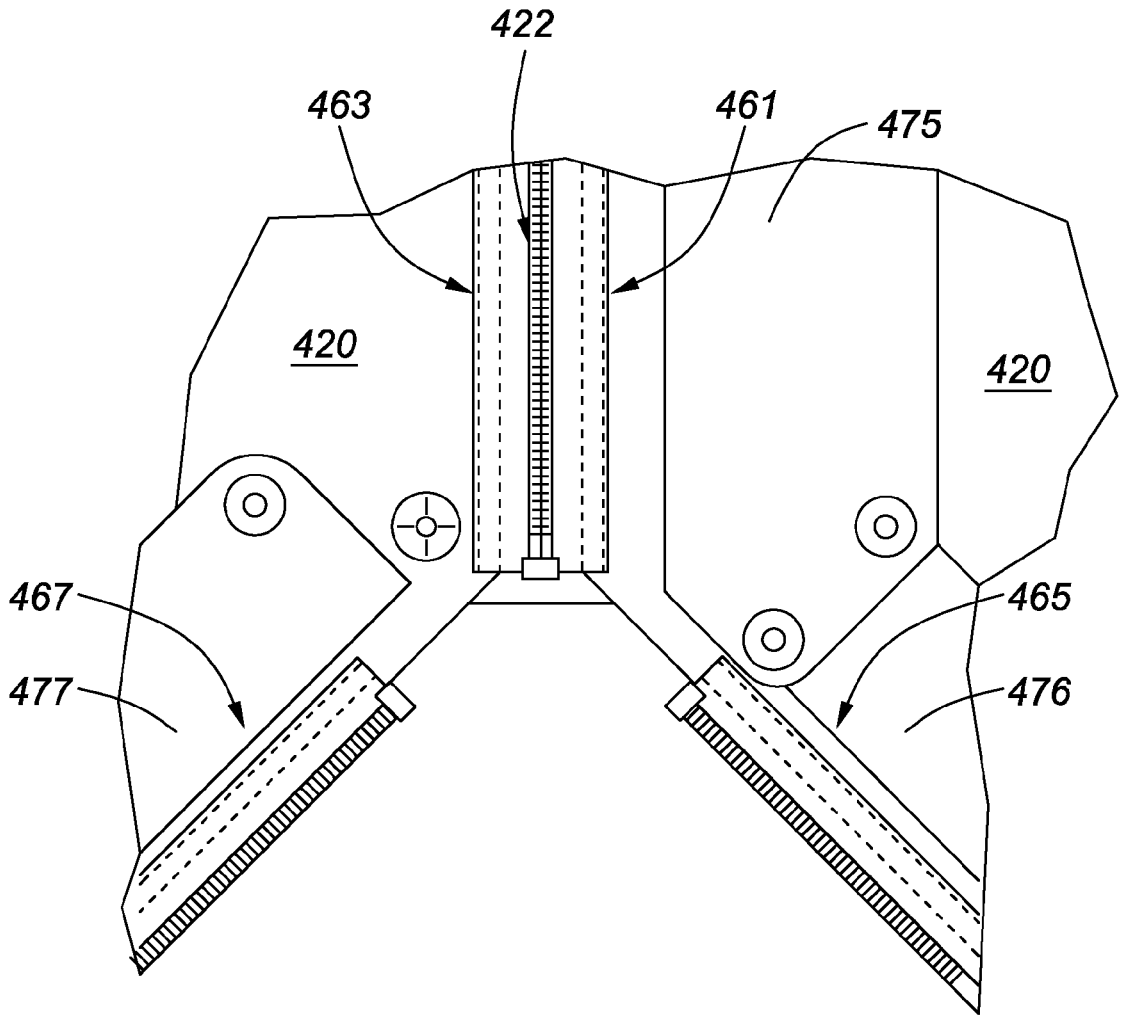
FIG. 24 is a frontal detail view of a trunk portion of the garment of FIG. 21.
Figure 25:
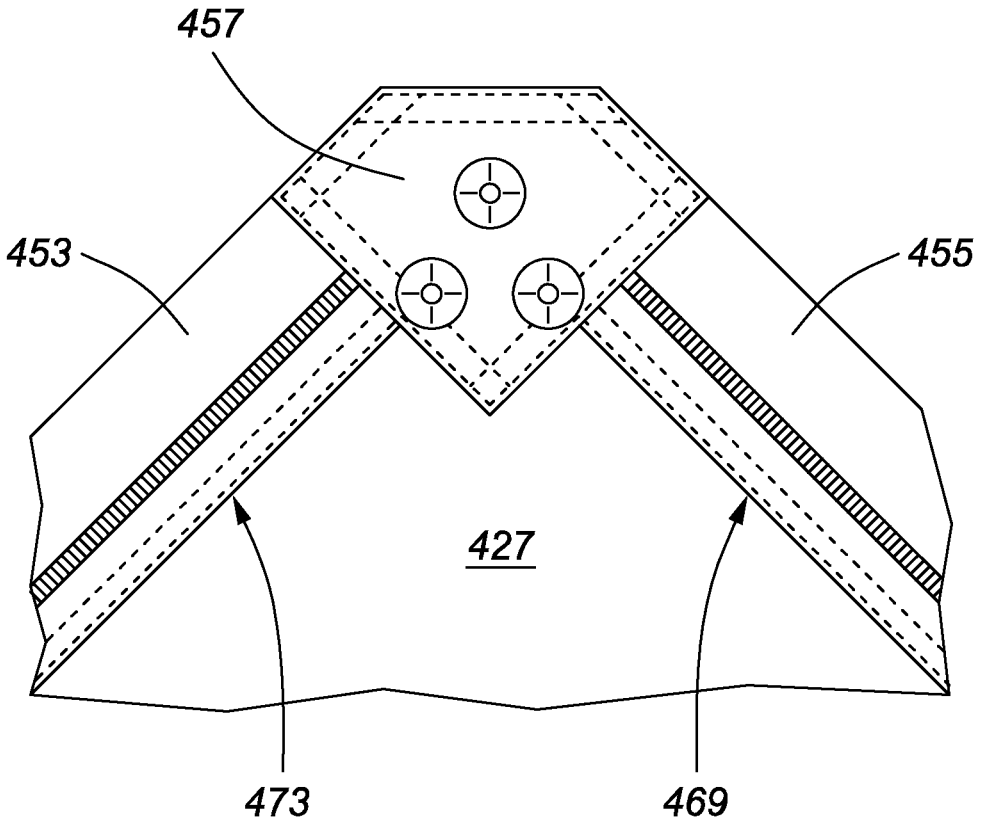
FIG. 25 is a frontal detail view of an intermediate flap of the garment of FIG. 21.
Figure 26:
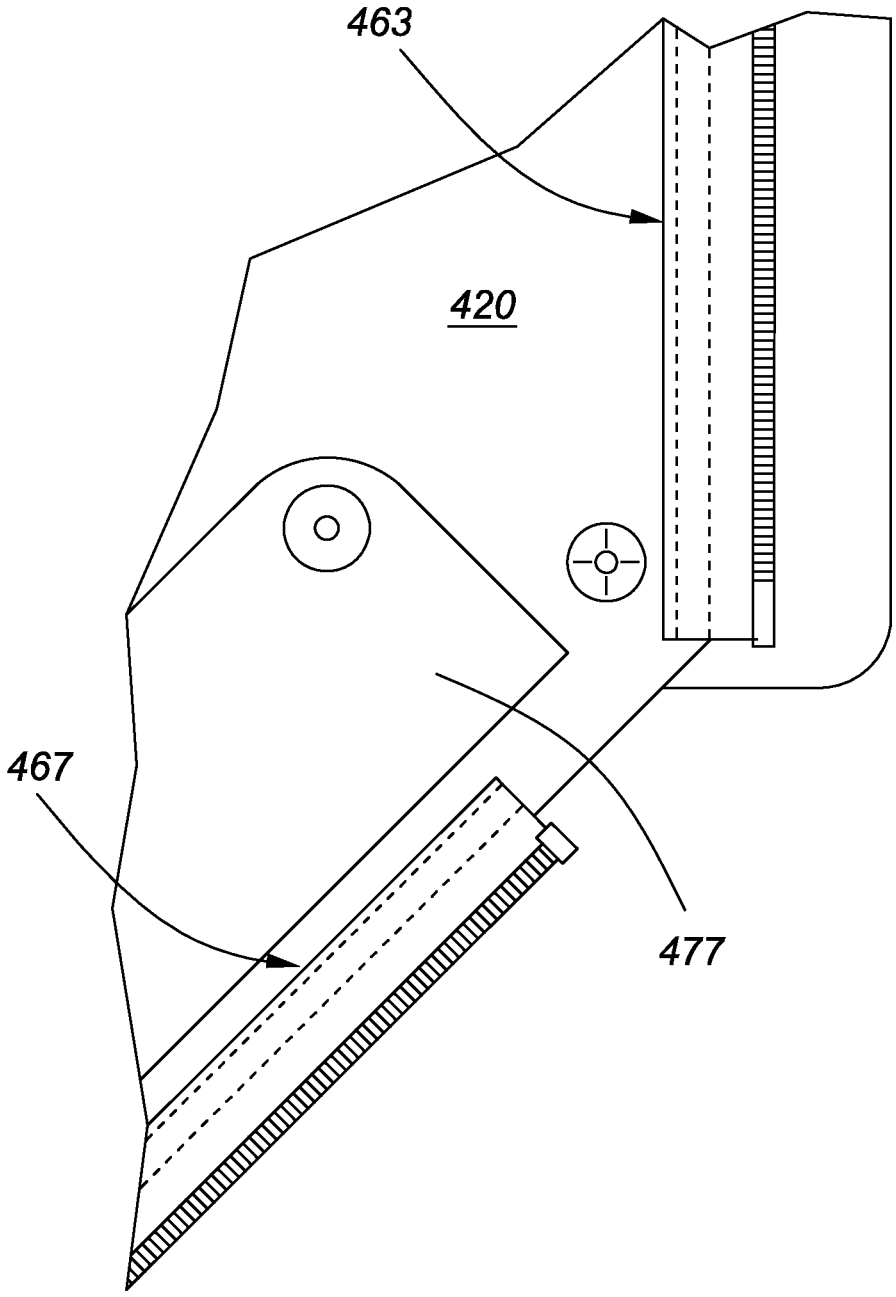
FIG. 26 is a frontal detail view of the trunk portion of the garment of FIG. 21.

FIGS. 3 to 5 are frontal, side, and rear views of a garment 10 being worn by a user 2 with bulky footwear 3, 4. The garment 10 includes a trunk portion 20, a left leg portion 30, and a right leg portion 40. A trunk opening 22 extends along the trunk portion 20 between a distal trunk opening end 28 and an opening point 24. A left leg opening 32 extends between the opening point 24 and a left distal end 34 of the left leg portion 30. A right leg opening 42 extends between the opening point 24 and a right distal end 44 of the right leg portion 40. The left leg opening 32 extends along a left path 50 on the left leg portion 30. The right leg opening 42 extends along a right path 60 on the right leg portion 40. Collectively, the trunk opening 22, the left leg opening 32, and the right leg opening 42 comprise a garment opening 12. The trunk opening 22, left leg opening 32, and right leg opening 42 converge at the opening point 24. The garment opening 12 is continuous from the left distal end 34 and right distal end 44 through the opening point 24 and to the distal trunk opening end 28. In FIGS. 3 to 5, the distal trunk opening end 28 is shown at a neck opening 29. However, the distal trunk opening end 28 may alternatively be located at any point that allows the garment 10 to be donned or doffed as discussed below (e.g. below the neck opening, on a shoulder portion, etc.). The garment opening 12 is shown as closed in FIGS. 3 to 5. The garment opening 12 may be reversibly closable by any suitable fastener (e.g. zippers, buttons, snaps, hook-and-loop fasteners, etc.). A lip may extend along the garment opening to cover the fastened garment opening 12 when closed (e.g. the connectors 475, 476, 477, 478, and 479 of FIG. 21).

Figure 6:
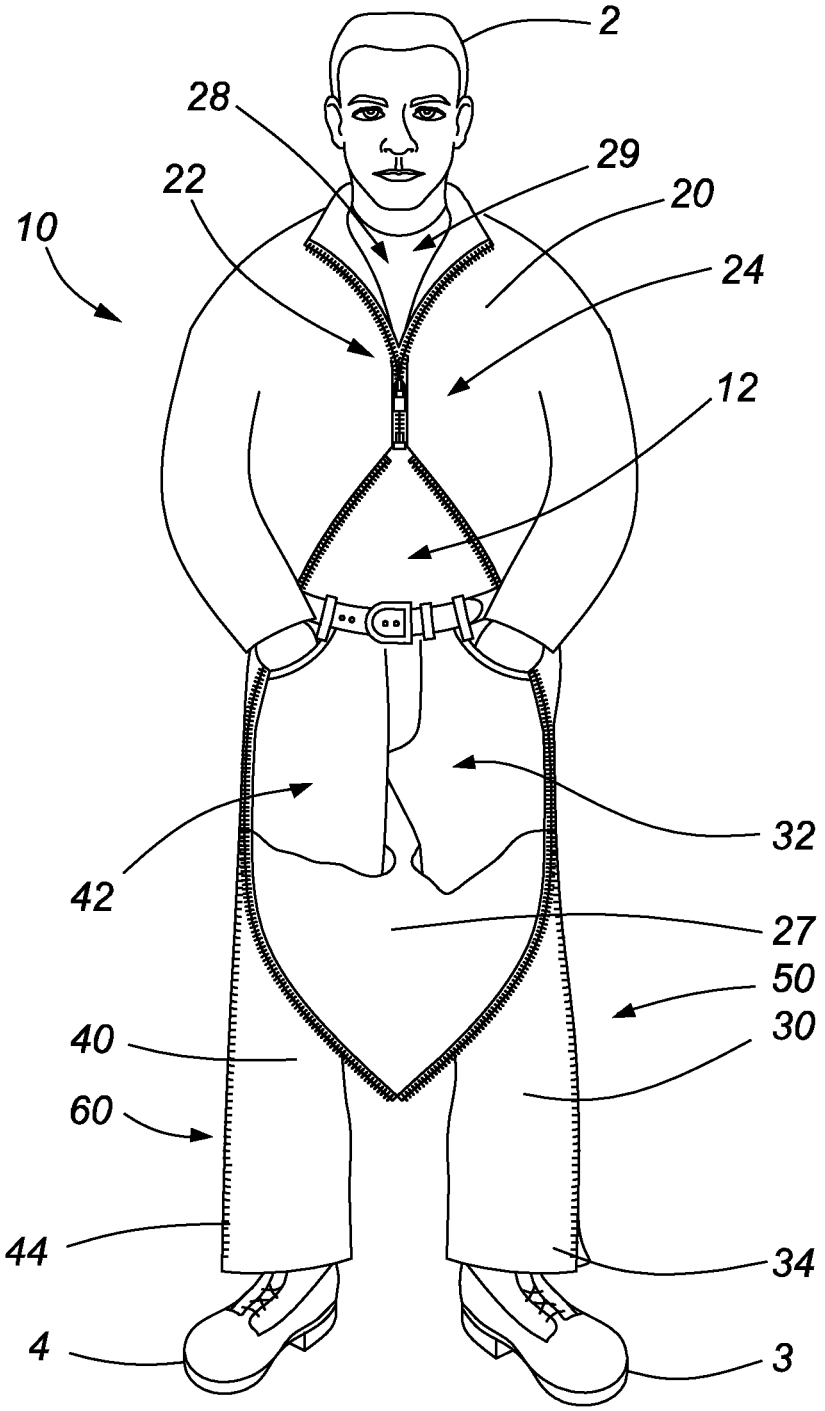
FIG. 6 is a frontal view of the garment of FIG. 3 with a partially open opening.

FIG. 6 is a frontal view of the garment 10 with a partially open garment opening 12.

Figure 7:
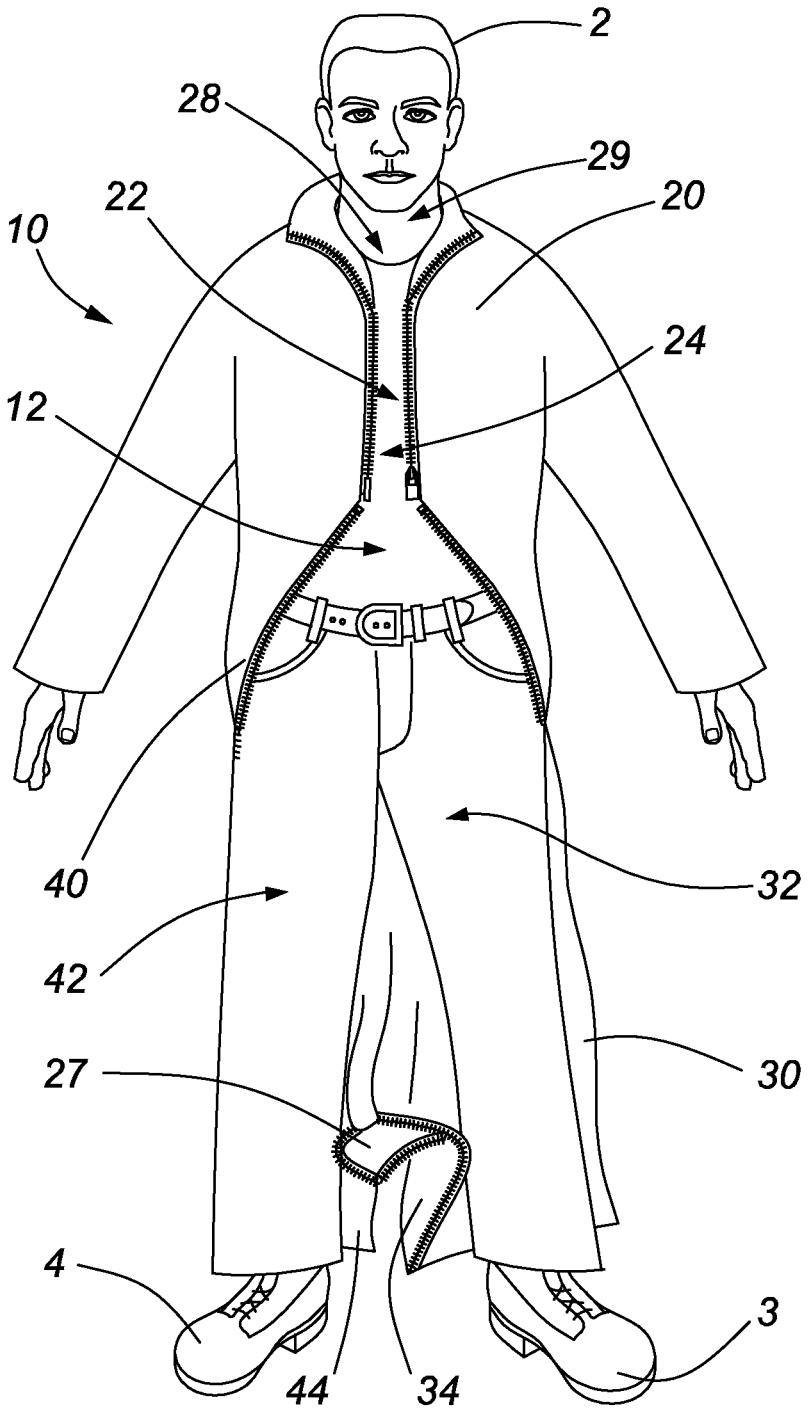
FIG. 7 is a frontal view of the garment of FIG. 3 with a fully open opening.

FIG. 7 is a frontal view of the garment 10 with a fully open garment opening 12. The opening point 24 is shown as being on the trunk portion 20 and generally above a hip portion 26 of the garment 10, but may alternatively be placed in any suitable location on the garment 10. The hip portion 26 corresponds generally to where the hips of the user 2 would be located while wearing the garment 10. The opening point 24 may be positioned on the trunk portion 20 sufficiently low that an intermediate flap 27 defined below the opening point 24 will hang free and not touch a surface upon which the user 2 stands when the garment opening 12 is open (as shown in FIG. 7). The intermediate flap 27 is defined by portions of the trunk portion 20 and of the left and right leg portions 30, 40.

Figure 8:
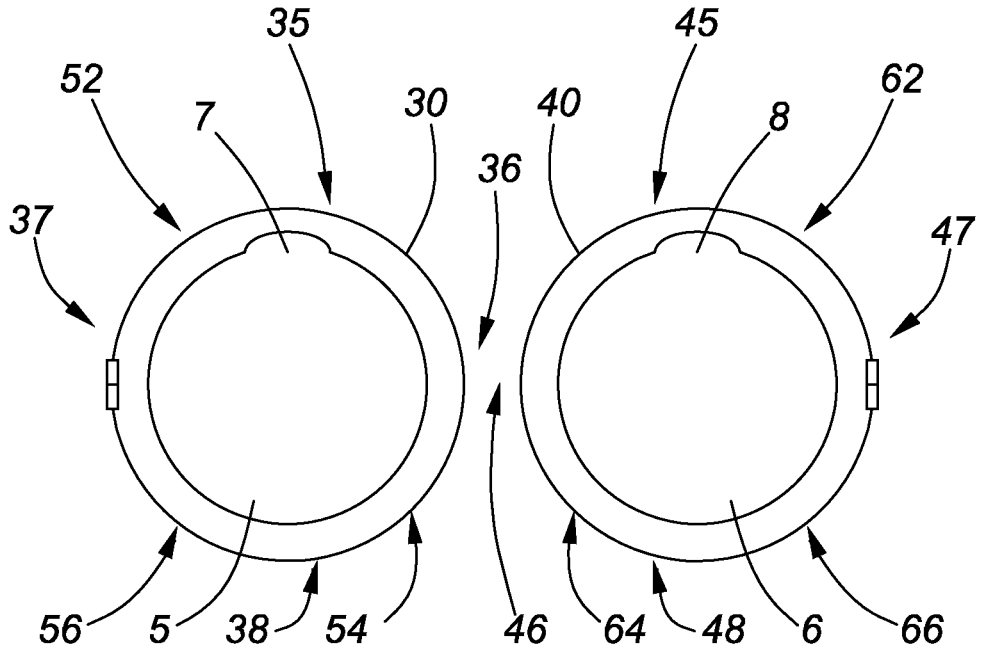
FIG. 8 is a cross-sectional view of the garment of FIG. 3 about the axis 8-8.

FIG. 8 is a cross-sectional view of the garment 10 about the axis 8-8, looking down along the user's left leg 5 and right leg 6, showing the user's left knee 7 and right knee 8. A left frontal centerline portion 35, a left inside leg portion 36, a left outside leg portion 37, and a left rear centerline portion 38 are shown on the left leg portion 30. A right frontal centerline portion 45, a right inside leg portion 46, a right outside leg portion 47, and a right rear centerline portion 48 are shown on the right leg portion 40.

In FIG. 4, the right path 60 is shown extending along the right outside leg portion 47. The left path 50 is not visible in FIG. 4, but would similarly extend along the left outside leg portion 37. Alternatively, the right path 60 may extend along the right leg portion 40 between a right first midpoint 62 and a right second midpoint 64. The right first midpoint 62 is radially midway between the right frontal centerline portion 45 and the right outside leg portion 47. The right second midpoint 64 is radially midway between the right rear centerline portion 48 and the right inside leg portion 46. The left path 50 similarly may extend along the left leg portion 30 between a left first midpoint 52 and a left second midpoint 54.

Alternatively, the right path 60 may extend along the right leg portion 40 between the right first midpoint 62 and a right third midpoint 66, which is radially midway between the right outside leg portion 47 and the right rear centerline portion 48. The left path 50 similarly may extend along the left leg portion 30 between the left first midpoint 52 and a left third midpoint 56. Alternatively, the right path 60 may extend along the right leg portion 40 within about 30 degrees of the right outside leg portion 47. Similarly, the left path 50 may extend along the left leg portion 30 within about 30 degrees of the left outside leg portion 37. Alternatively, the right path 60 may extend along the right leg portion 40 within about 15 degrees of the right outside leg portion 47. Similarly, the left path 50 may extend along the left leg portion 30 within about 15 degrees of the left outside leg portion 37.

Figure 9:
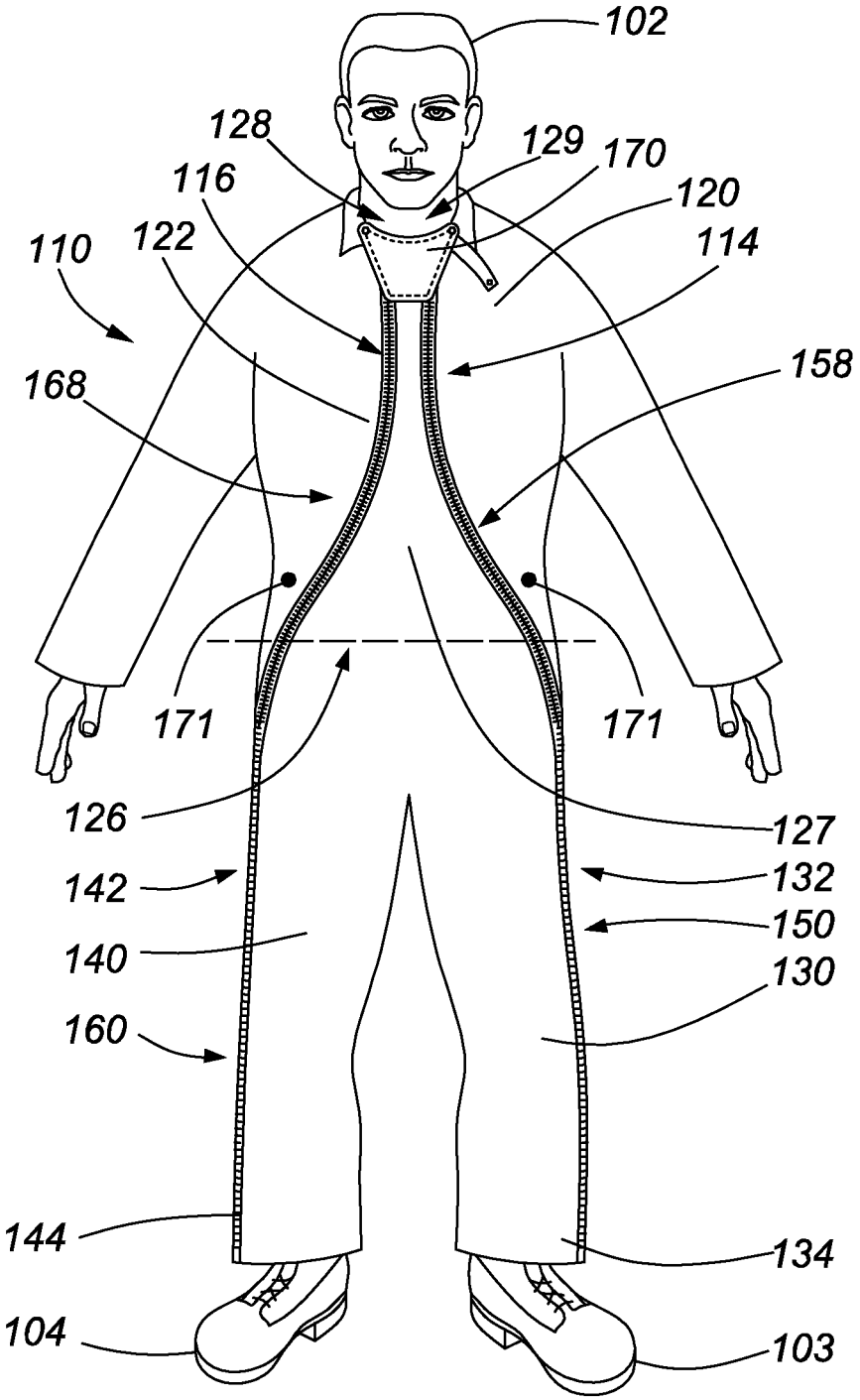
FIG. 9 is a frontal view of a garment in accordance with a further embodiment of the present disclosure with closed openings.

FIG. 9 is a frontal view of a garment 110 having a left garment opening 114 and a right garment opening 116. The intermediate flap 127 is defined between the left and right garment openings 114, 116. A connector flap 170 extends from the intermediate flap 127 to the trunk portion 122 across the first garment opening 114 and across the second garment opening 116. Any connector suitable for connecting the intermediate flap 127 to the trunk portion 122 could be used in place of the connector flap 170 (e.g. a cord, chain, clip, etc.). The garment 110 includes a connection point 171 (e.g. a snap, hook, etc.) proximate the hip portion 126 for connecting to the connector flap 170. In FIG. 9, the left and right garment openings 114, 116 are each closed.

Figure 10:
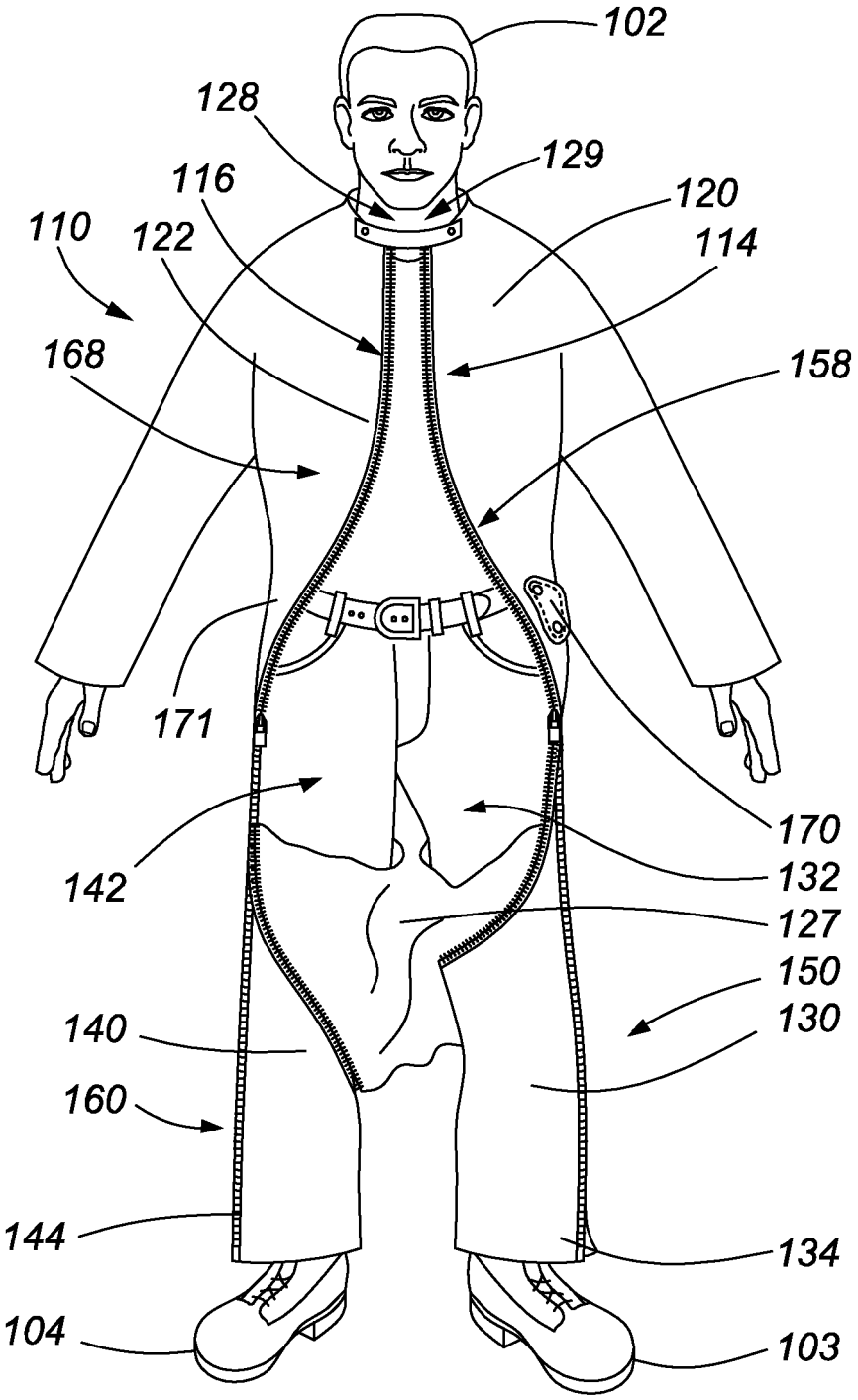
FIG. 10 is a frontal view of the garment of FIG. 9 with partially open openings.
Figure 11:
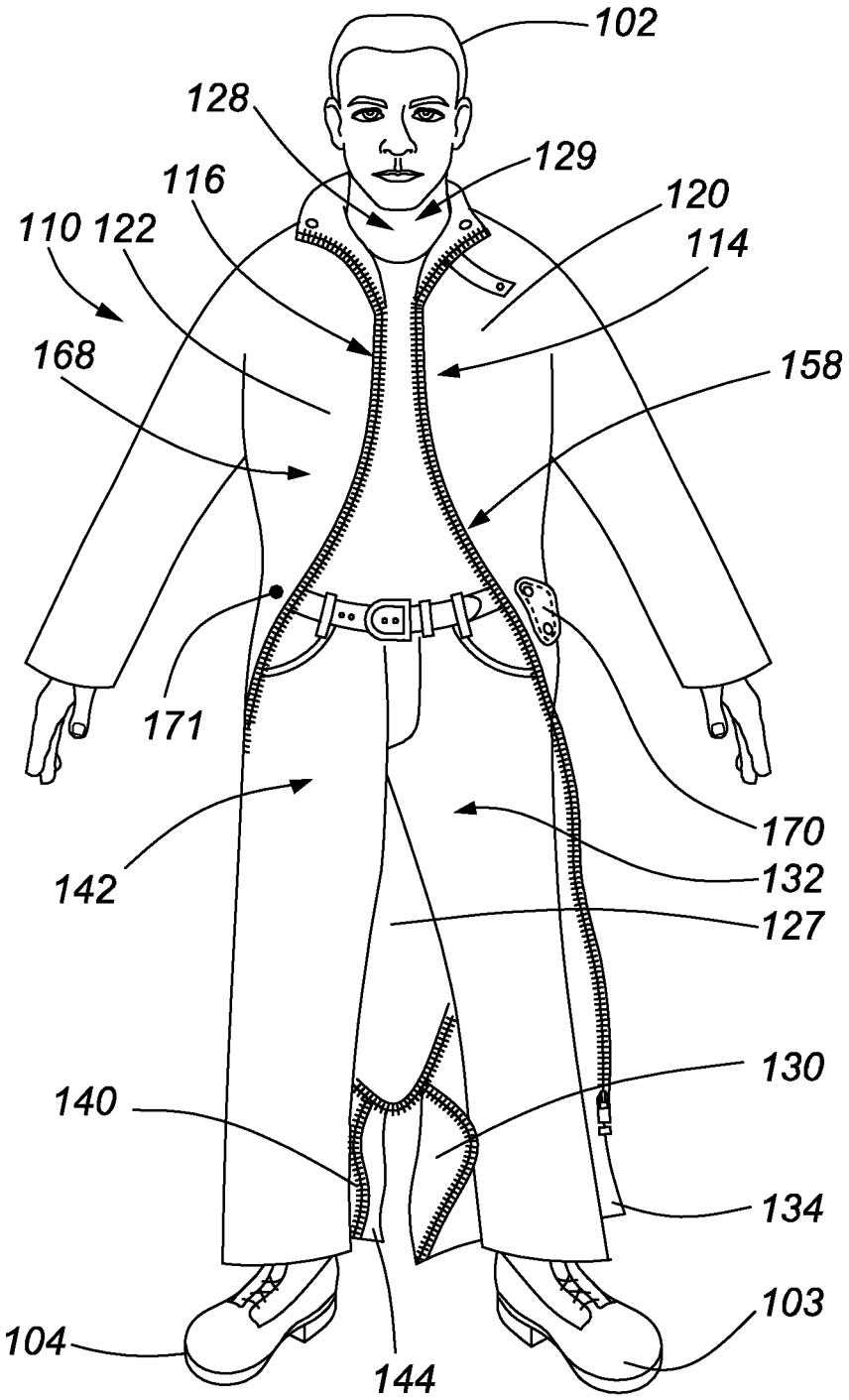
FIG. 11 is a frontal view of the garment of FIG. 9 with fully open openings.

FIGS. 10 and 11 show the garment 110 wherein the left and right garment openings 114, 116 are each partially open and fully open, respectively.

The left garment opening 114 extends between the distal trunk opening end 128 and the left distal end 134. The left garment opening 114 includes a left trunk opening 158 and the left leg opening 132. The left trunk opening 158 extends between the distal trunk opening end 128 and the left leg opening 132, which extends to the left distal end 134. The left leg opening 132 follows the left path 150 along the left leg portion 130.

Similarly, the right garment opening 116 extends between the distal trunk opening end 128 and the right distal end 144. The right garment opening 116 includes a right trunk opening 168 and the right leg opening 142. The right trunk opening 168 extends between the distal trunk opening end 128 and the right leg opening 142, which extends to the right distal end 144. The right leg opening 142 follows the right path 160 along the right leg portion 140.

Figure 12:
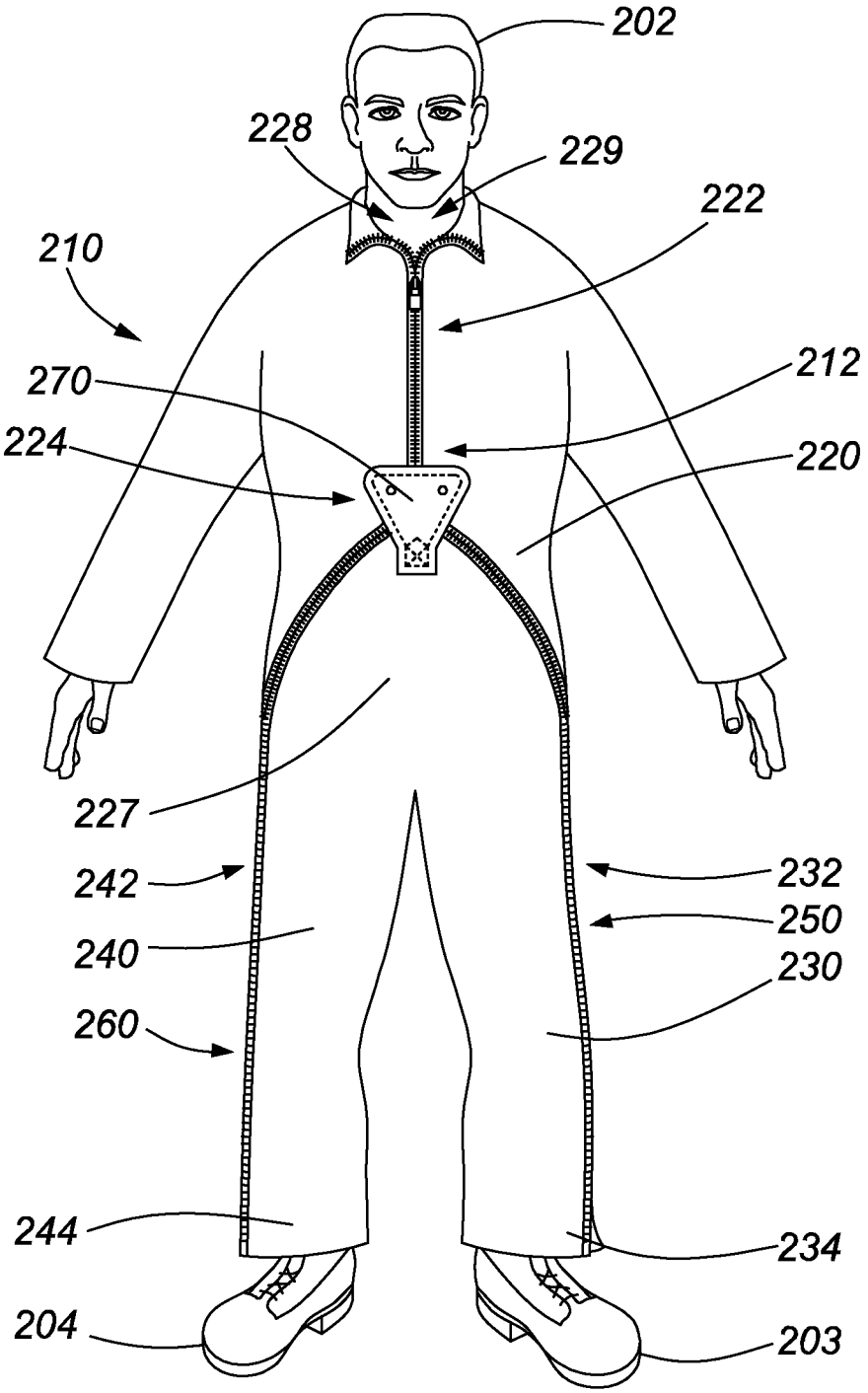
FIG. 12 is a frontal view of a garment in accordance with a further embodiment of the present disclosure with a closed opening.

FIG. 12 is a frontal view of a garment 210 having a connector flap 270 at the opening point 224. In FIG. 12, the garment opening 212 is closed.

FIG. 13 is a frontal view of the garment 210 with the left and right leg openings 232, 242 open across the trunk portion 220, between the opening point 224 and upper ends of the paths 250, 260. FIG. 13 illustrates how the user 202 may conveniently access pockets of clothes worn beneath the garment 210 without fully opening the left and right leg openings 232, 242.

Figure 14:
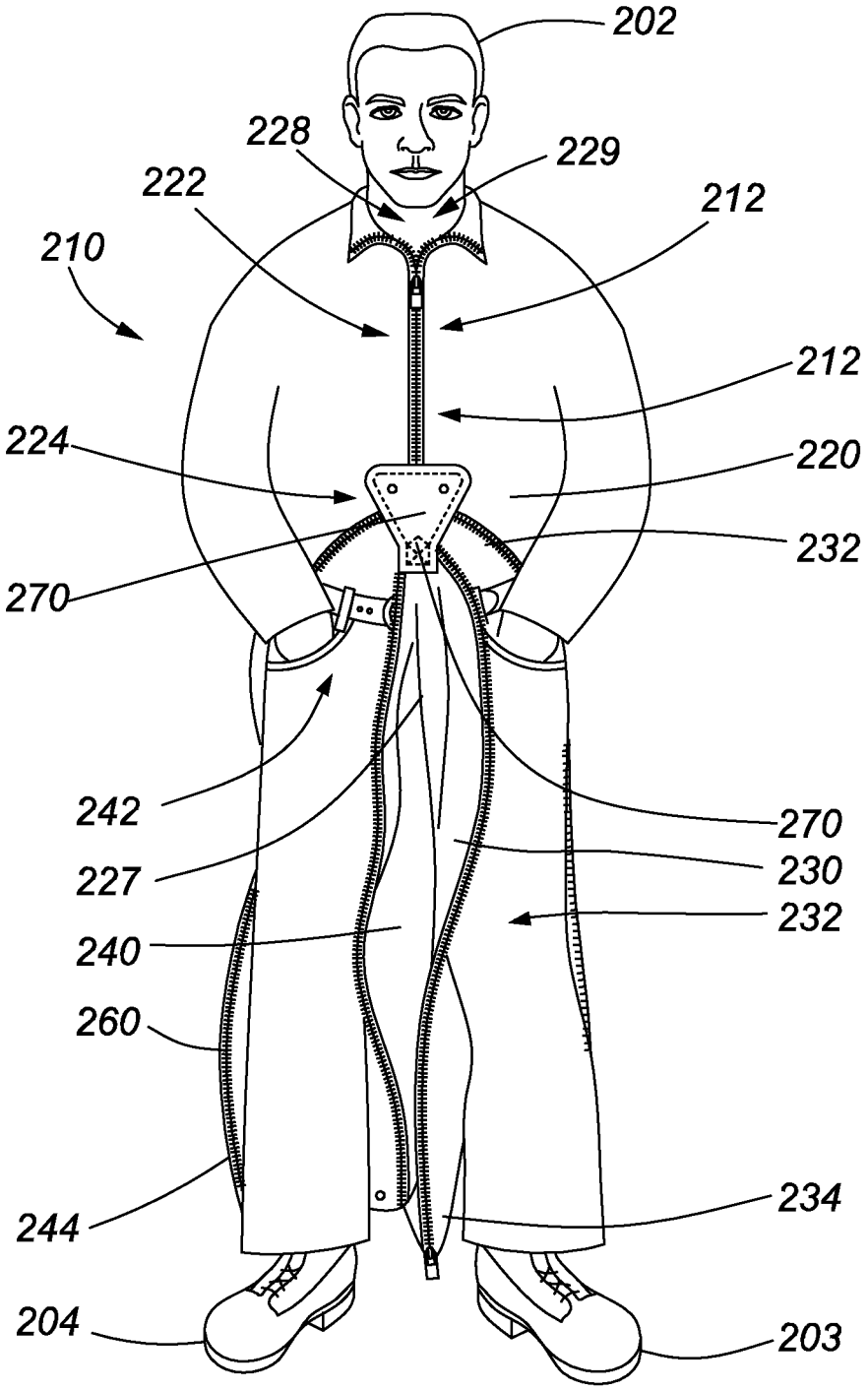
FIG. 14 is a frontal view of the garment of FIG. 12 with fully open leg openings.

FIG. 14 is a frontal view of the garment 210 with left and right leg openings 232, 242 fully open, illustrating how the connector flap 270 connects the intermediate flap 227 to the trunk portion 220 at the opening point 224. The connector flap 270 connects the intermediate flap 227 to the trunk portion 220 across the trunk opening 222, the left leg opening 232, the right leg opening 242, and the opening point 224. This holds the left and right leg openings 232, 242 partially closed near the opening point 224, facilitating fastening the left and right leg openings 232, 242. The connector flap 270 includes a fastener for connecting the intermediate flap 227 to the trunk portion 220. In addition to connecting the intermediate flap 227 to the trunk portion 220, the connector flap 270 covers the opening point 224. The convergence of the trunk opening 222 with the left and right leg openings 232, 242 may result in a small hole which is covered by the connector flap 270. In addition, where zippers are used to close the garment opening 212, the connector flap 270 may protect pulls of the zippers from dirt, grease, grit, or other environmental hazards. The connector flap 270 may be a contrasting colour to the trunk portion 220 of the garment to facilitate locating the connector flap 270 (e.g. for emergency egress) or when the intermediate flap 227 is hanging between the user's 228 legs during donning.

Figure 15:
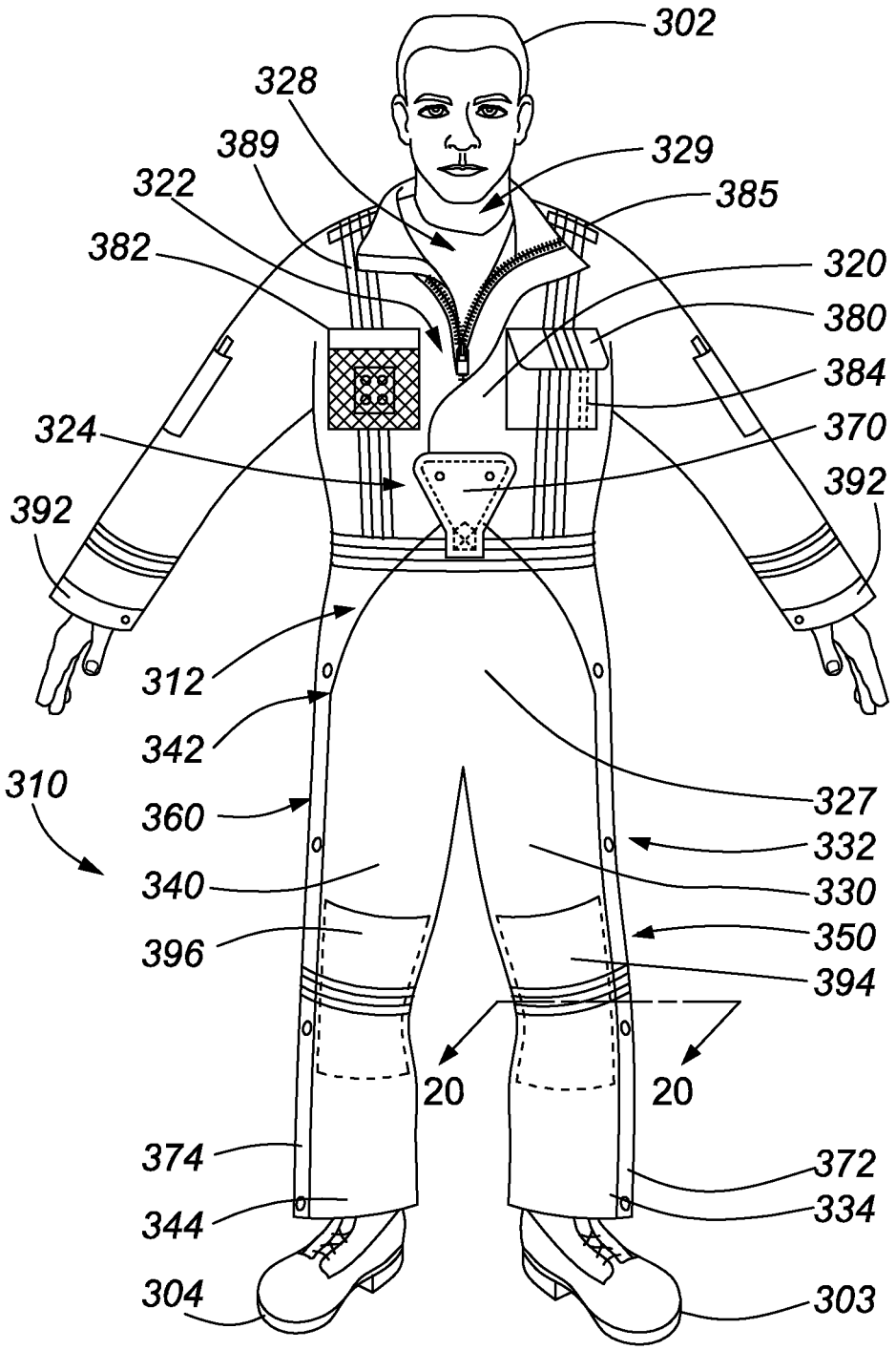
FIG. 15 is a frontal view of a garment in accordance with a further embodiment of the present disclosure.
Figures 16, 17:
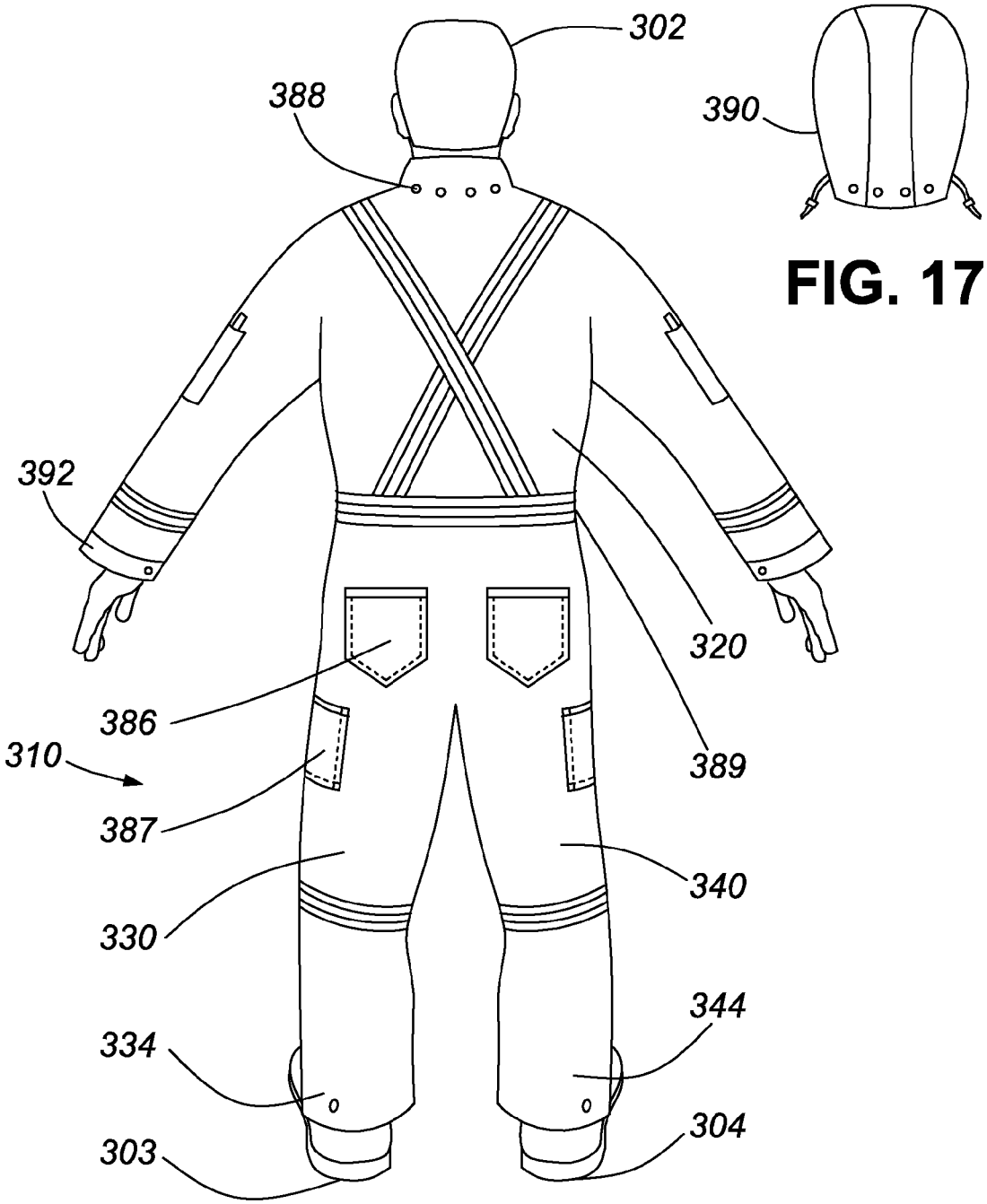
FIG. 16 is a rear view the garment of FIG. 15.
FIG. 17 is a rear view of a hood for attachment to the garment of FIG. 15.

FIGS. 15 and 16 are frontal and rear views of a garment 310. FIG. 17 is a rear view of a removable hood 390 for the garment 310. The garment 310 includes a closable breast pocket 380, a mesh pocket with a fastener closure 382 (e.g. for a portable gas detector, etc.), individual pen pockets 384, button snaps 388 for the removable hood 390, adjustable cuffs 392, a left knee pad 394, and a right knee pad 396. Other features may include back pockets 386, pocket flaps, reinforced side pockets 387, CSA reflective striping 389, a sturdy piece of fabric webbing 385 (e.g. to hold a radio, microphone, etc.), etc.

Figure 18:
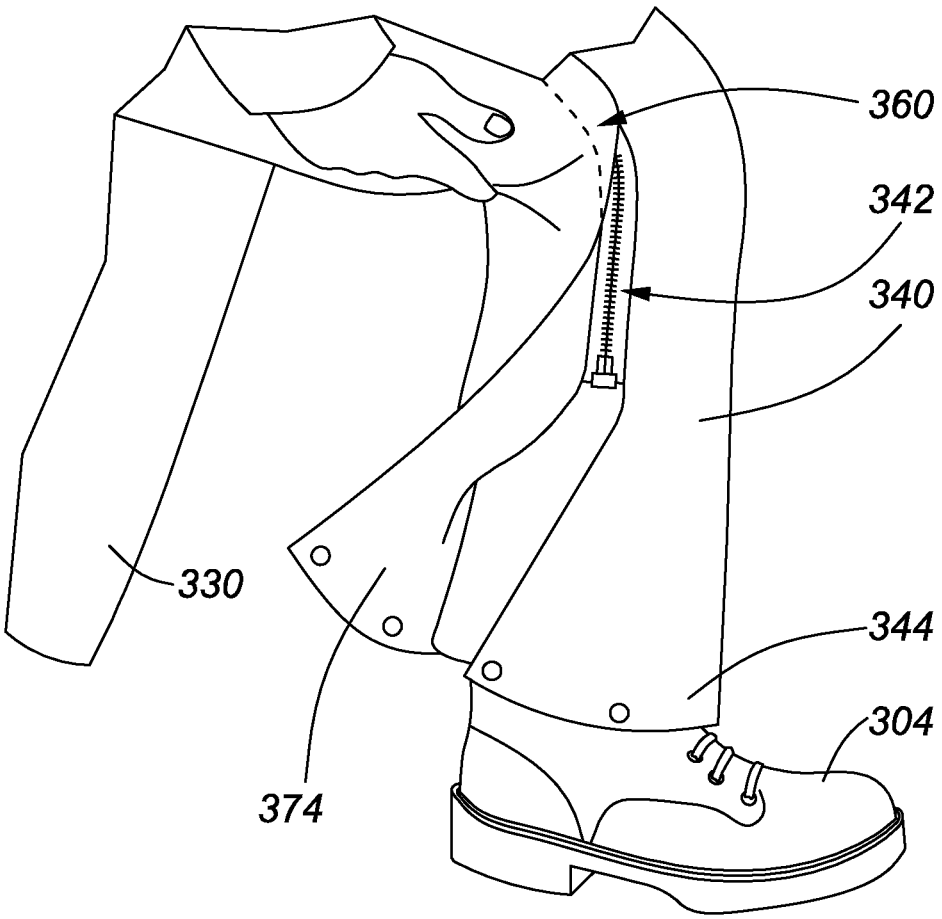
FIG. 18 is a detail side view of a right leg portion of the garment of FIG. 15 with an open right leg flap.
Figure 19:
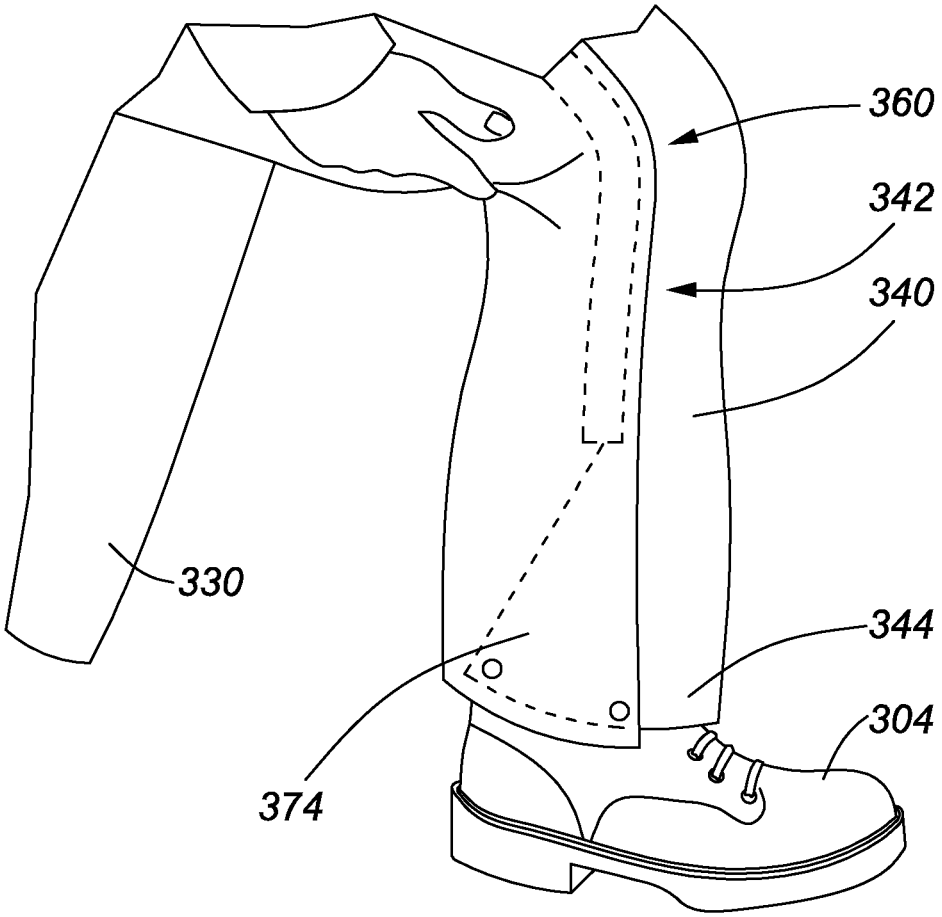
FIG. 19 is a detail side view of the right leg portion of FIG. 18 with a closed right leg flap.

FIGS. 18 and 19 are detail views of the right leg portion 340 of the garment 310. A right leg flap 374 near the right distal end 344 is in an open position in FIG. 18 and a closed position in FIG. 19. The right leg flap 374 facilitates closing the right leg portion 340 around the right footwear 304. Similarly, a left leg flap 372 facilitates closing the left leg portion 330 around the left footwear 303. In addition, the left and right leg flaps 372, 374 allow the fasteners (shown in FIGS. 15 to 19 as zippers) to be elevated above the ground, mitigating the effects of wear and fastener malfunction caused by mud, contamination, or grit on the fasteners, and to facilitate hemming the leg portions 330, 340.

Figure 20:
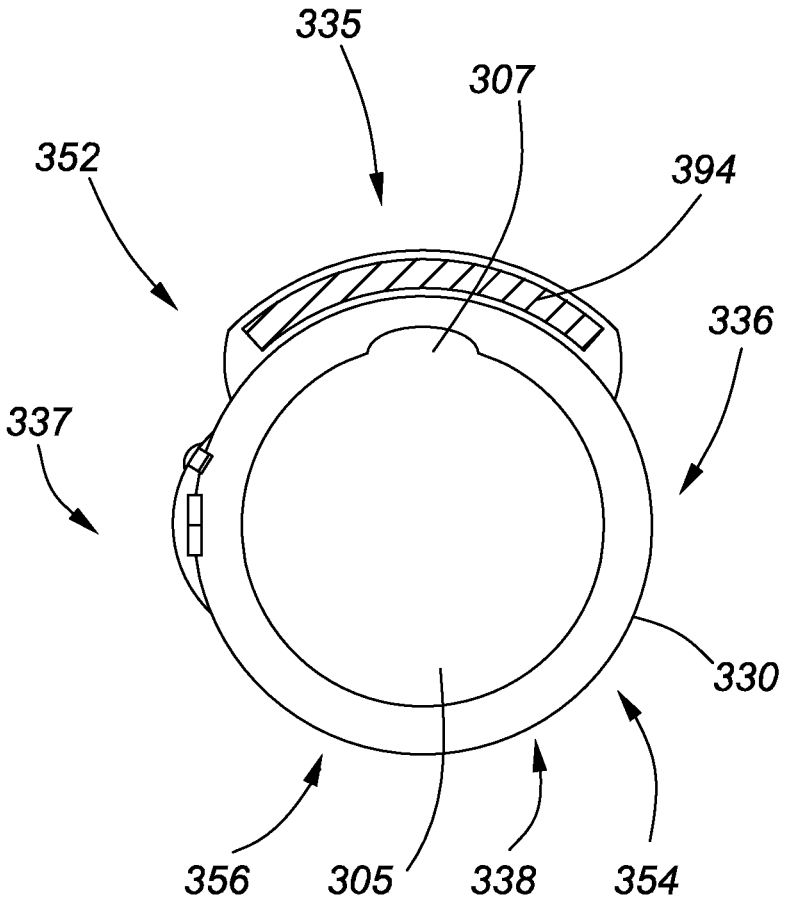
FIG. 20 is a cross-sectional view of the garment of FIG. 15 about the axis 20-20.

FIG. 20 is a cross-sectional view of the garment 310 about the axis 20-20. The left knee pad 394 is shown inserted within the left leg portion 330.

FIGS. 21 to 26 show a garment 410. The garment 410 includes a trunk connector 475, a first leg connector 476, a second leg connector 477, a third leg connector 478, and a fourth leg connector 479.

The trunk connector 475 extends from the garment 410 along a first trunk opening side 461 and across the trunk opening 422 to connect to the garment 410 on a second trunk opening side 463. The trunk connector 475 also extends across the opening point 424 to connect to the intermediate flap 427. The trunk connector 475, first leg connector 476, and second leg connector 477 each connect to a tab 457. The tab 457 extends from the intermediate flap 427.

The first leg connector 476 extends from the garment 410 along a first side 465 of the left leg opening 432 and across the left leg opening 432 to connect to the garment 410 on a second side 469 of the left leg opening 432. The second leg connector 477 extends from the garment 410 along a first side 467 of the right leg opening 442 and across the right leg opening 442 to connect to the garment 410 on a second side 473 of the right leg opening 442.

The third leg connector 478 extends from the garment 410 along the second side 469 of the left leg opening 432 and across the left leg opening 432 to connect to the garment 410 on the first side 465 of the left leg opening 432. The fourth leg connector 479 extends from the garment 410 along the second side 473 of the right leg opening 442 and across the right leg opening 442 to connect to the garment 410 on the first side 467 of the right leg opening 442.

The connectors 475, 476, 477, 478, and 479 are each shown as a lip that covers the fasteners of the trunk opening 422 and leg openings 432, 442. Other connectors could be used. For some fasteners, including zippers, covers such as connectors 475, 476, 477, 478, and 479 protect the fasteners from exposure to grime, grit, fluids, electrical arcs, and other hazards. The first and second leg connectors 476, 477 extend from the garment 410 on the first sides 465, 467 of the leg openings 432, 442, mitigating deposition of grime, grit, fluids, and other contaminants between the first and second leg connectors 476, 477 and the underlying fasteners and portions of the garment 410 by downward flow or dripping of such contaminants. The third and fourth leg connectors 478, 479 extend from the garment 410 on the second sides 469, 473 of the leg openings 432, 442, mitigating lifting of the third and fourth leg connectors 478, 479 from the underlying garment 410 on a frontal face of the garment. Such lifting may expose the fasteners to grime, grit, fluids, electrical arcs, and other hazards the individual 402 may be facing towards. Where the fasteners are zippers, inner zipper flaps 453, 455 may be continuous along the respective lengths of the leg openings 432, 442, facilitating a smooth zipper pull on the paired first and third leg connectors 476, 478 and paired second and fourth leg connectors 477, 479.

The connectors 475, 476, 477, 478, and 479 are shown as connecting to the underlying garment 410 by snap connections. Any other suitable connections may be used (e.g. Velcro, hooks, buttons, etc.).

Operation

FIGS. 3, 6, and 7 show the garment 10 with the garment opening 12 closed, partially open, and fully open, respectively. When donning the garment 10 (or alternatively the garments 210, or 310), the user 2 may open the garment opening 12 and don the garment 10 by being received within the fully open garment opening 12. When being received within the garment opening, the user 2 may don the trunk portion 22 and allow the left and right leg portions to surround the user's legs 5, 6 (e.g. similarly to donning a trench coat or other long coat, etc.). The user 2 may then fasten the garment opening 12 closed, for example beginning with the trunk opening 22, then fastening each of the left and right leg openings 32, 42.

FIGS. 9, 10, and 11 show the garment 110 with the left and right garment openings 114, 116 closed, partially open, and fully open, respectively. Where the garment 110 is being donned, the user 102 is received within the fully open left and right garment openings 114, 116. As with the garment 10, donning the garment 110 with open left and right garment openings 114, 116 is comparable to donning a trench coat or other long coat, etc. The user 102 may then fasten the left and right garment openings 114, 116 closed. The connection point 171 may be used to connect the connector flap 170 to the garment 110 to prevent the intermediate flap 127 from contacting the ground underfoot when the left and right garment openings 114, 116 are partially open or fully open.

FIGS. 12, 13, and 14 show the garment 210 with the garment opening 212 fully closed, with the left and right leg openings 232, 242 partially open, and with the left and right leg openings 232, 242 fully open, respectively. Where the garment 210 is being donned, the user 202 is received within the fully open garment opening 212. As with the garment 10, donning the garment 210 with the fully open garment opening 212 is comparable to donning a trench coat or other long coat, etc. The garment opening 212 is then fastened closed. The trunk opening 222 may be closed, then the connector flap 270 may be used to connect the intermediate flap 227 to the trunk portion 220 at the opening point 224 (as shown in FIG. 14). Connecting the intermediate flap 227 to the trunk portion 220 with the connector flap 270 prior to closing the left and right leg openings 232, 242 brings the left and right leg portions 230, 240 bordering the left and right leg openings 232, 242 closer together and may facilitate closing the left and right leg openings 232, 242.

FIGS. 18 and 19 show details of the right leg portion 340 of the garment 310. Donning and doffing the garment 310 is similar to the garment 210, as the garment 310 includes the trunk opening 322, the left and right leg openings 332, 342, the opening point 324, and the connector flap 370. In addition, when the garment 310 is being donned, the left and right leg flaps 372, 374 are also used to close the right and left leg openings 332, 342. As discussed above, this may mitigate damage to fasteners from being exposed to dirt, grease, grit, etc.

Donning and doffing the garment 10 (or alternatively the garments 110, 210, 310, or 410) can be easily completed from the standing position while wearing bulky footwear 3, 4. The height on the trunk 20 of the opening point 24 may be chosen to provide an intermediate flap 27 sized to hang free and not contact a surface on which the user 2 stands (e.g. see FIG. 7, and for the garment 110, see FIG. 11). As a result, the garment 10 can be kept in a substantially upright position throughout the donning and doffing process, mitigating unintentional dropping of items from pockets. The user 2 can access items stored in frontal pockets of pants worn underneath the garment 10 by partially opening the left and right leg openings 32, 42 as shown in FIG. 6 (or the left and right garment openings 114, 116 as shown in FIG. 10, or the left and right leg openings 232, 242 as shown in FIGS. 13 and 14).

EXAMPLE

The time required to don and doff the conventional coveralls P01, and to don and doff a pair of coveralls prepared in accordance with the garment 210, were each recorded. The trials were directed to simulating a situation where a user would don their coveralls beginning with work boots on, or doff their coveralls with the intention of having work boots on after doffing (e.g. as would arise when using dining facilities, entering a vehicle, using a washroom, etc.). In each case, the coveralls were donned and doffed without the benefit of a chair and a calculator was kept in a breast pocket to simulate a gas detector.

The conventional coveralls P01 were donned beginning with work boots on, but laces not tied. One work boot was doffed, the corresponding leg inserted into the conventional coveralls P01, then the boot was re-donned. This was then repeated for the other work boot and leg. The work boots had nine eyelets.

The conventional coveralls P01 were doffed by untying and doffing work boots, doffing the conventional coveralls P01, then donning the work boots but not re-tying the laces. The conventional coveralls P01 had buttons as a fastener. The buttons were not done up after donning; rather a simulated zipper pulling motion was used to include time for a zipper pull in the data. The results are shown in Table 1.

TABLE 1

Conventional Coveralls

| Trial | Donning Time (sec)* | Tying Up Boots Time (sec) | Total Donning Time** (sec) | Doffing Time (sec) | Calculator Dropped? | Foot touched ground? |
|---|---|---|---|---|---|---|
| 1 | 31 | 45 | 76 | 44 | Yes | Yes |
| 2 | 28 | 49 | 77 | 45 | Yes | Yes |
| 3 | 31 | 48 | 79 | 45 | Yes | Yes |
| 4 | 34 | 46 | 80 | 51 | Yes | Yes |
| 5 | 28 | 47 | 75 | 42 | Yes | Yes |
| Average | 30 | 47 | 77 | 45 | N/A | N/A |

*donning coveralls only (not including tying up boots)
donning coveralls and tying up boots The coveralls prepared in accordance with the garment 210 were donned while wearing work boots. Donning was carried out by receiving the user's arms and trunk in the trunk portion, closing the trunk opening 222, then using the connector flap 270 to secure the intermediate flap 227 to the trunk portion 220 and closing zippers on the leg openings 232, 242. The coveralls prepared in accordance with the garment 210 were then doffed while wearing the work boots. Donning and doffing were each completed from a standing position. The results are shown in Table 2. In one instance (not shown in table), the connector flap 270** was not used. This resulted in a donning time of 69 seconds.

TABLE 2

Coveralls Prepared in Accordance with Garment 210

| Trial | Donning Time (sec) | Doffing Time (sec) | Calculator Dropped? |
|---|---|---|---|
| 1 | 62 | 11 | No |
| 2 | 57 | 12 | No |
| 3 | 58 | 10 | No |
| 4 | 45 | 11 | No |
| 5 | 53 | 11 | No |
| Average | 55 | 11 | N/A |

For the conventional coveralls P01, the average donning time was 77 seconds (including lacing up boots) and average doffing time was 45 seconds (estimated 92 seconds if the boots are laced after doffing). For coveralls prepared in accordance with the garment 210, the average donning time was 55 seconds and the average doffing time was 11 seconds, beginning and ending with laced up and tied work boots in each case. Since coveralls prepared in accordance with the garment 210 were donned while wearing work boots, the donning time is estimated at about 102 seconds starting from no footwear (i.e. including time for lacing the work boots).

In terms of time, the coveralls prepared in accordance with the garment 210 were doffed significantly faster than the conventional coveralls P01 where the end state of the user is wearing laced up and tied work boots but no coveralls. Coveralls prepared in accordance with the garment 210 took more time to don than the conventional coveralls P01 beginning from no footwear, but took less time to don than the conventional beginning with wearing work boots.

The coveralls prepared in accordance with the garment 210 could be donned and doffed without removing work boots. This saves time when donning and doffing in situations where the user wishes to remove coveralls prepared in accordance with the garment 210 and wishes to keep work boots on, as no untying or retying of the work boots is necessary. This also eliminates the possibility of the user's foot touching the ground without footwear (since the work boots are kept on during donning and doffing). As discussed above, this would facilitate removal of coveralls in situations where users of conventional coveralls (e.g. those of P01, P02, etc.) would like to completely doff their coveralls but for the sake of convenience or necessity, keep their coveralls on or partially on (e.g. when using dining facilities, entering a vehicle, using a washroom, etc.). In addition, the coveralls prepared in accordance with the garment 210 were kept in a substantially upright position during donning and doffing, with the result that the calculator (simulating a gas detector) was not dropped when doffing the coveralls prepared in accordance with the garment 210, and the trunk portion of the coveralls prepared in accordance with the garment 210 did not touch the ground during donning and doffing. In contrast, the calculator was dropped in each trial of doffing the conventional coveralls P01.

Examples Only

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art without departing from the scope, which is defined solely by the claims appended hereto.

What is claimed is:

1. A garment comprising:

a trunk portion;

a pair of leg portions extending from the trunk portion;

a trunk opening extending along the trunk portion between a distal trunk opening end and an opening point on the trunk portion;

a pair of leg openings extending between distal ends of the leg portions and the opening point, the leg openings extending along the leg portions on a pair of paths which avoid a kneecap portion, an inside leg portion, and an area between the kneecap portion and the inside leg portion, of each leg portion; and fasteners for reversibly closing the trunk opening and the leg openings;

wherein the trunk opening intersects with the leg openings proximate the opening point for facilitating donning and doffing the garment by receiving a user within the trunk opening and leg openings; and the paths extend along the leg portions within a pair of path cross-sectional areas of the leg portions, each path cross-sectional area being between a first midpoint and a second midpoint, the first midpoint located between a frontal centerline portion of the leg portion and an outside leg portion of the leg portion, and the second midpoint located between a rear centerline portion of the leg portion and the inside leg portion.

2. The garment of claim 1 wherein the path cross-sectional areas are each between the first midpoint and a third midpoint, the third midpoint located between the rear centerline of the leg portion and the outside leg portion.

3. The garment of claim 2 wherein the path cross-sectional areas are within about 30 degrees of the outside leg portions.

4. The garment of claim 3 wherein the path cross-sectional areas are within about 15 degrees of the outside leg portions.

5. The garment of claim 4 wherein the paths extend substantially along the outside leg portions.

6. The garment of claim 1 wherein the paths extend in substantially straight lines along the leg portions.

7. The garment of claim 1 further comprising a connector extending from a first point on the garment for connecting to a second point on the garment, the second point being across the trunk opening from the first point.

8. The garment of claim 1 further comprising a connector extending from a first point on the garment for connecting to a second point on the garment, the second point being across a first leg opening of the pair of leg openings from the first point.

9. The garment of claim 8 wherein the connector is further for connecting to a third point on the garment, the third point being across a second leg opening of the pair of leg openings from the first point.

10. The garment of claim 1 further comprising a connector extending from a first point on the garment for connecting to a second point on the garment, the second point being across the opening point from the first point.

11. The garment of claim 1 further comprising a trunk connector extending from the garment along a first side of the trunk opening for connecting to the garment on a second side of the trunk opening.

12. The garment of claim 11 wherein the trunk connector extends from the garment along the first side of the trunk opening for connecting to the garment across the opening point from the first side of the trunk opening.

13. The garment of claim 11 further comprising:

a first leg connector extending from the garment along a first side of a first leg opening of the pair of leg openings for connecting to the garment on a second side of the first leg opening; and a second leg connector extending from the garment along a first side of a second leg opening of the pair of leg openings for connecting to the garment on a second side on the second leg opening.

14. The garment of claim 13 wherein:

the first leg connector extends along the first side of the first leg opening from the opening point to a first point; and the second leg connector extends along the first side of the second leg opening from the opening point to a second point;

the garment further comprising:

a third leg connector extending along the second side of the first leg opening from the first point to a third point for connecting to the garment on the first side of the first leg opening; and a fourth leg connector extending along the second side of the second leg opening from the second point to a fourth point for connecting to the garment on the first side of the first leg opening; and wherein the first side of each leg opening faces a rear of the garment and the second side of each leg opening faces a front of the garment.

15. The garment of claim 14 wherein the first point and the second point are each proximate a hip portion of the garment.

16. The garment of claim 14 wherein the third point and the fourth point are each proximate an end of each leg portion of the pair of leg portions.

17. The garment of claim 14 wherein:

the fasteners comprise a trunk zipper for closing the trunk opening, a first leg zipper for closing the first leg opening, and a second leg zipper for closing the second leg opening; and the trunk connector comprises a lip for covering the trunk zipper, the first leg connector and third leg connector each comprise a lip for covering the first leg zipper, and the second leg connector and fourth leg connector each comprise a lip for covering the second leg zipper.

18. The garment of claim 1 wherein the opening point is located above a hip portion of the garment.

19. The garment of claim 1 wherein the distal trunk opening end is located at a neck opening of the trunk portion.

20. The garment of claim 1 further comprising leg flaps proximate the distal ends of the leg portions for wrapping around the user's legs to secure the leg portions around the user's legs.

21. A garment comprising:

a trunk portion;

a pair of leg portions extending from the trunk portion;

a pair of openings extending along the trunk portion and the leg portions between a distal trunk opening end and distal ends of the leg portions to facilitate donning and doffing the garment by receiving a user within the openings, the openings extending along the leg portions on a pair of paths which avoid a kneecap portion, an inside leg portion, and an area between the kneecap portion and the inside leg portion, of each leg portion; and fasteners for reversibly closing the openings;

wherein the paths extend along the leg portions within a pair of path cross-sectional areas of the leg portions, each path cross-sectional area being between a first midpoint and a second midpoint, the first midpoint located between a frontal centerline portion of the leg portion and an outside leg portion of the leg portion, and the second midpoint located between a rear centerline portion of the leg portion and the inside leg portion.

22. The garment of claim 21 wherein the path cross-sectional areas are each between the first midpoint and a third midpoint, the third midpoint located between the rear centerline of the leg portion and the outside leg portion.

23. The garment of claim 22 wherein the path cross-sectional areas are within about 30 degrees of the outside leg portions.

24. The garment of claim 23 wherein the path cross-sectional areas are within about 15 degrees of the outside leg portions.

25. The garment of claim 24 wherein the paths extend substantially along the outside leg portions.

26. The garment of claim 21 wherein the paths extend in substantially straight lines along the leg portions.

27. The garment of claim 21 further comprising a connector extending from a first point on the garment for connecting to a second point on the garment, the second point being across a first opening of the pair of openings from the first point.

28. The garment of claim 27 wherein the connector is further for connecting to a third point on the garment, the third point being across a second opening of the pair of openings from the first point.

29. The garment of claim 27 wherein the first point is on an intermediate flap defined between the pair of openings and further comprising a connection point on the garment for connecting to the connector to prevent the intermediate flap from contacting a surface upon which the user is standing when the pair of openings are open.

30. The garment of claim 21 wherein the distal trunk opening end is located at a neck opening of the trunk portion.

31. The garment of claim 21 further comprising leg flaps proximate the distal ends of the leg portions for wrapping around the user's legs to secure the leg portions around the user's legs.

32. A garment comprising:

a trunk portion;

a pair of leg portions extending from the trunk portion;

a trunk opening extending along the trunk portion between a distal trunk opening end and an opening point on the trunk portion;

a pair of leg openings extending between distal ends of the leg portions and the opening point, the leg openings extending along the leg portions on a pair of paths which extend along the leg portions within a cross-sectional area of the leg portions within about 15 degrees of outside leg portions of the leg portions;

fasteners for reversibly closing the trunk opening and the leg openings; and a connector extending from a first point on the garment for connecting to a second point on the garment, the second point being across a first leg opening of the pair of leg openings from the first point;

wherein the trunk opening intersects with the leg openings proximate the opening point for facilitating donning and doffing the garment by receiving a user within the trunk opening and leg openings; and the connector is further for connecting to a third point on the garment, the third point being across a second leg opening of the pair of leg openings from the first point.

33. The garment of claim 32 wherein the paths extend substantially along the outside leg portions.

* * * * *